US009798266B2

(12) United States Patent
Agata et al.

(10) Patent No.: US 9,798,266 B2
(45) Date of Patent: Oct. 24, 2017

(54) IMAGE FORMING APPARATUS FOR PREVENTING ABNORMALLY DISCHARGED IMAGE

(71) Applicant: CANON KABUSHIKI KAISHA, Tokyo (JP)

(72) Inventors: Shinichi Agata, Suntou-gun (JP); Kosuke Ikada, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/221,923

(22) Filed: Jul. 28, 2016

(65) Prior Publication Data

US 2017/0031258 A1 Feb. 2, 2017

(30) Foreign Application Priority Data

Jul. 31, 2015 (JP) ..... 2015-152508

(51) Int. Cl.

*G03G 15/00* (2006.01)
*G03G 15/02* (2006.01)
*G03G 21/08* (2006.01)

(52) U.S. Cl.

CPC ..... *G03G 15/0266* (2013.01); *G03G 15/553* (2013.01); *G03G 21/08* (2013.01); *G03G 15/5033* (2013.01)

(58) Field of Classification Search

CPC ..... G03G 15/0266; G03G 15/043; G03G 15/5037; G03G 21/08; G03G 21/0064

See application file for complete search history.

(56) References Cited

U.S. PATENT DOCUMENTS 7,403,727 B2 7/2008 Fujimori et al.
7,580,654 B2 8/2009 Okubo
(Continued)

FOREIGN PATENT DOCUMENTS

JP S6195372 A 5/1986
JP H02134258 A 5/1990
(Continued)

OTHER PUBLICATIONS

Copending U.S. Appl. No. 15/222,338, filed Jul. 28, 2016.

*Primary Examiner* — Walter L Lindsay, Jr.
*Assistant Examiner* — Jessica L Eley
(74) *Attorney, Agent, or Firm* — Rossi, Kimms & McDowell LLP

(57) ABSTRACT

An image forming apparatus includes: a first exposing unit exposing a surface of a charged photosensitive member to form a latent image; a second exposing unit exposing the surface of the photosensitive member after the surface of the photosensitive member passes a transfer position at which a toner image obtained by causing toner to adhere to the latent image is transferred to a transferred body and before the surface of the photosensitive member reaches a charging position; and a control unit varying a length of a period from a timing at which a portion of the photosensitive member exposed by the second exposing unit is initially charged by the charging member to a timing at which the first exposing unit starts formation of the latent image when performing image formation based on a print signal, based on information related to a photosensitive layer thickness of the photosensitive member.

30 Claims, 16 Drawing Sheets

(56) References Cited

U.S. PATENT DOCUMENTS

| | | | | |
|---|---|---|---|---|
| 8,041,244 | B2 | 10/2011 | Kojima | |
| 2009/0022517 | A1* | 1/2009 | Kanai | G03G 15/0208 399/128 |
| 2013/0308964 | A1* | 11/2013 | Adachi | G03G 15/553 399/26 |
| 2014/0178086 | A1* | 6/2014 | Kitamura | G03G 15/5008 399/46 |
| 2014/0178087 | A1* | 6/2014 | Suzuki | G03G 15/011 399/50 |

FOREIGN PATENT DOCUMENTS

| | | | |
|---|---|---|---|
| JP | H07301971 | A | 11/1995 |
| JP | 2002318519 | A | 10/2002 |
| JP | 2003114554 | A | 4/2003 |
| JP | 2005165217 | A | 6/2005 |
| JP | 2006133333 | A | 5/2006 |
| JP | 2007065389 | A | 3/2007 |
| JP | 2007094387 | A | 4/2007 |
| JP | 2009042738 | A | 2/2009 |
| JP | 2010026442 | A | 2/2010 |

* cited by examiner

NO ABNORMAL DISCHARGE

ABNORMAL DISCHARGE HAS OCCURRED

FIG. 16A
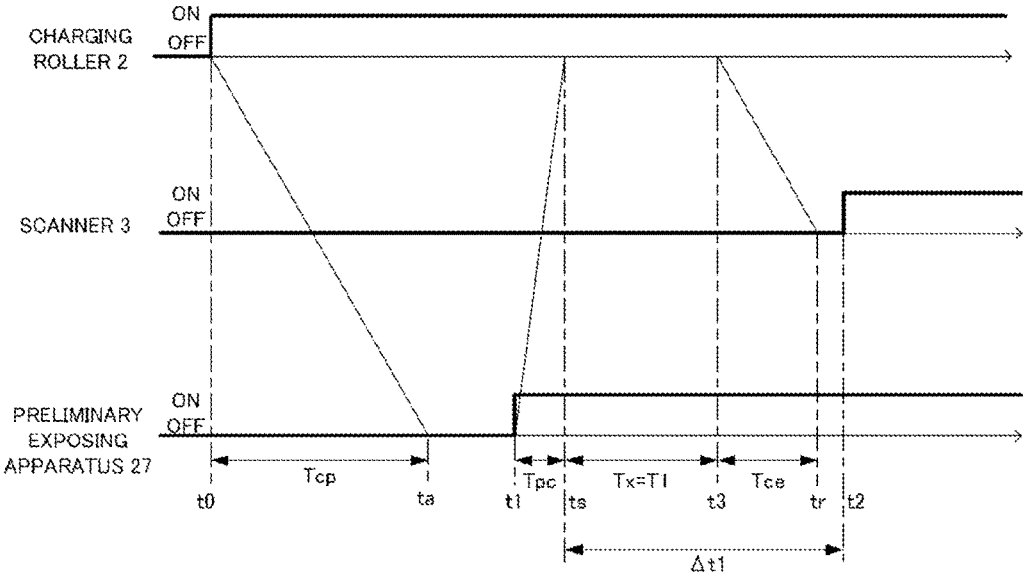
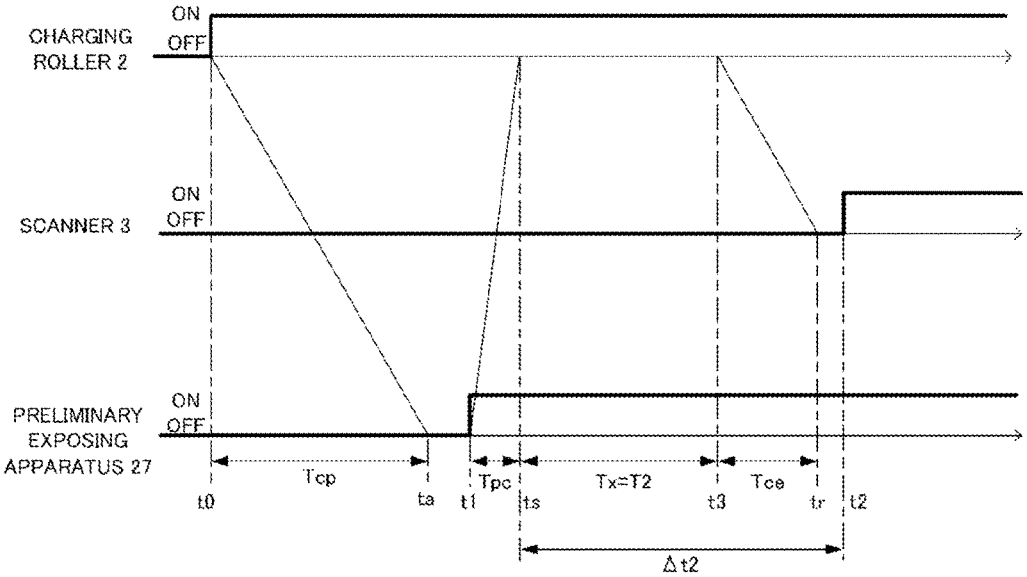
FIG. 16B

IMAGE FORMING APPARATUS FOR PREVENTING ABNORMALLY DISCHARGED IMAGE

BACKGROUND OF THE INVENTION

Field of the Invention

The present invention relates to an image forming apparatus which forms an image on recording material using an electrophotographic system.

Description of the Related Art

Examples of conventional image forming apparatuses using an electrophotographic system include an electrophotographic copier, an electrophotographic printer (such as an LED printer and a laser beam printer), and an electrophotographic facsimile device. In an image forming apparatus of this type, a surface of an electrophotographic photosensitive member (hereinafter, referred to as a photosensitive drum or a drum) is uniformly charged by a primary charger and the charged photosensitive drum surface is exposed by an exposing apparatus to form an electrostatic latent image. The electrostatic latent image is then developed by a developing apparatus to form a developer image (hereinafter, referred to as a toner image) and the toner image is transferred to recording material such as a sheet by a transferring apparatus. Subsequently, the toner image is output by fixing the toner image onto the recording material as a fixed image by a fixing apparatus. Toner remaining on the surface of the photosensitive drum after toner image transfer is cleaned by a cleaning apparatus and the photosensitive drum stands by for a next image forming operation.

In recent years, an increasing number of image forming apparatuses are mounted with charging apparatuses adopting a contact charging system which have become a mainstream in charging apparatuses. Most contact charging systems utilize roller charging in which a conductive roller is used as a contact charging member and voltage is applied by bringing the conductive roller into contact with a photosensitive drum. There are further a DC system in which a surface of a photosensitive drum is charged by only applying DC voltage to a contact charging member and an AC superposition system in which a surface of a photosensitive drum is charged by superimposing DC voltage on AC voltage and applying the superimposed voltage to a contact charging member. According to the AC superposition system, while there is an advantage in that the surface of the photosensitive drum can be uniformly charged, discharges occur repetitively in accordance with a frequency of the AC voltage. As a result, the surface of the photosensitive drum sustains damage, an amount of abrasion increases, and product life of the photosensitive drum is reduced. In contrast, with the DC system, since the number of discharges that occur in minute gaps is smaller than in an AC superposition system, less damage is sustained by the photosensitive drum and a longer product life of the photosensitive drum is achieved. However, charging a photosensitive drum particularly using a DC system creates the following problems.

On a surface of a photosensitive drum after image formation, surface potential has become nonuniform in accordance with a formed image. When charging is next performed in this state, depending on the previous formed image, uniform charging cannot be realized. As a result, surface potential of the photosensitive drum when exposed by an exposing apparatus such as a laser may also become nonuniform. In other words, a so-called ghost image may occur. More specifically, when a halftone image is formed after forming a pattern with high contrast, a so-called ghost image occurs in which the previous image pattern emerges in the halftone.

In consideration thereof, Japanese Patent Application Laid-open No. 2009-42738 proposes a configuration in which a surface of a photosensitive drum prior to charging is uniformly irradiated by a pre-charge exposing apparatus having a light source such as an LED. Accordingly, uniform charging is realized in a next charging operation by averaging potential of image portions (potential of bright parts) and potential of non-image portions (potential of dark parts) of the surface of the photosensitive drum when exposed by the exposing apparatus to prevent the occurrence of a ghost image.

However, in recent years, there have been demands for further extending product life of image forming apparatuses having a photosensitive drum for the purpose of reducing running cost. While the DC system is advantageous in that the amount of abrasion of the surface of a photosensitive drum is small, the surface of the photosensitive drum nevertheless deteriorates due to discharges and is subject to scuffing due to passing of paper or a cleaning member coming into contact with the surface. Consequently, a film thickness of the photosensitive drum decreases. In addition, while suppressing ghost images, since pre-charge exposure also lowers surface potential of the photosensitive drum prior to charge, an amount of discharge increases and, as a result, an amount of abrasion of the photosensitive drum increases.

In order to solve this problem, conceivably, an initial film thickness of a photosensitive drum may be increased while performing irradiation for preliminary exposure immediately prior to image formation (immediately prior to exposure) in order to minimize irradiation time of pre-charge exposure. However, Japanese Patent Application Laid-open No. 2009-42738 describes that an overcharge (abnormal discharge) of charged potential sometimes occurs when charging a region after irradiation for preliminary exposure to create a mesh-like abnormally discharged image. This occurs prominently when an initial film thickness of a drum is increased from the perspective of extending product life.

SUMMARY OF THE INVENTION

An object of the present invention is to provide an image forming apparatus capable of realizing longer product life while avoiding an occurrence of an abnormally discharged image.

Another object of the present invention is to provide an image forming apparatus performing image formation on recording material based on a print signal, the image forming apparatus comprising:

a photosensitive member;

a charging member which charges the photosensitive member at a charging position;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a control unit which controls a period from a timing at which a portion of the photosensitive member exposed by the second exposing unit is initially charged by the charging member to a timing at which the first exposing unit starts formation of the latent image when performing image formation based on the print signal, wherein the control unit varies a length of the period based on information related to a thickness of a photosensitive layer of the photosensitive member.

Another object of the present invention is to provide an image forming apparatus performing image formation on recording material based on a print signal, the image forming apparatus comprising:

a photosensitive member;

a charging member which charges the photosensitive member at a charging position;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a control unit which controls a period from a timing at which a portion of the photosensitive member exposed by the second exposing unit is initially charged by the charging member to a timing at which the first exposing unit starts formation of the latent image when performing image formation based on the print signal, wherein the control unit varies a length of the period based on environmental information.

Another object of the present invention is to provide an image forming apparatus performing image formation on recording material based on a print signal, the image forming apparatus comprising:

a photosensitive member;

a charging member which charges the photosensitive member at a charging position;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a control unit which controls a first period from a timing at which a portion of the photosensitive member exposed by the second exposing unit is initially charged by the charging member to a timing at which the first exposing unit starts formation of the latent image when performing image formation based on a print signal, wherein when a second period during which a charging current flowing through the charging member when the charging member charges the photosensitive member is equal to or larger than a desired value has a length of $T1$, the control unit sets the first period to $\Delta t1$, and when the length of the second period is $T2$, which is longer than $T1$, the control unit sets the first period to $\Delta t2$, which is longer than $\Delta t1$.

Another object of the present invention is to provide an image forming apparatus, comprising:

a photosensitive member which bears a toner image to be transferred to recording material;

a charging member which charges the photosensitive member;

a voltage applying portion which applies voltage to the charging member;

a current detecting portion which detects a current that flows through the charging member;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a first adjusting portion which adjusts an amount of exposure light of the first exposing unit, wherein when an image formation operation is executed after the second exposing unit exposes the photosensitive member, a magnitude of voltage to be applied to the charging member by the voltage applying portion is adjusted based on a value of a current detected by the current detecting portion so that a current value of a current flowing through the charging member has a magnitude that prevents a region of the photosensitive member charged by the charging member after being exposed by the second exposing unit from entering an overcharged state, and the first adjusting portion adjusts an amount of exposure light so that a difference between a magnitude of an absolute value of surface potential of the photosensitive member formed when voltage of a magnitude adjusted by the voltage applying portion is applied to the charging member and a magnitude of an absolute value of surface potential of the photosensitive member formed when the first exposing unit exposes the charged photosensitive member is equal to a prescribed magnitude.

Another object of the present invention is to provide an image forming apparatus, comprising:

a photosensitive member which bears a toner image to be transferred to recording material;

a charging member which charges the photosensitive member;

a voltage applying portion which applies voltage to the charging member;

a current detecting portion which detects a current that flows through the charging member;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a second adjusting portion which adjusts an amount of exposure light of the second exposing unit, wherein when an image formation operation is executed after the second exposing unit exposes the photosensitive member, the second adjusting portion adjusts an amount of exposure light based on a value of a current detected by the current detecting portion so that a current value of a current flowing through the charging member has a magnitude that prevents a region of the photosensitive member charged by the charging member after being exposed by the second exposing unit from entering an overcharged state.

Further features of the present invention will become apparent from the following description of exemplary embodiments (with reference to the attached drawings).

BRIEF DESCRIPTION OF THE DRAWINGS

FIGS. 16A and 16B are timing charts similar to FIG. 15 showing timing control according to the present invention.

DESCRIPTION OF THE EMBODIMENT

A mode for implementing the present invention will now be exemplarily described in detail based on practical examples with reference to the drawings. It is to be understood that dimensions, materials, shapes, relative arrangements, and the like of components described in the embodiment are intended to be changed as deemed appropriate in accordance with configurations and various conditions of apparatuses to which the present invention is to be applied. In other words, the scope of the present invention is not intended to be limited to the embodiment described below.

FIRST PRACTICAL EXAMPLE

<Schematic Configuration of Image Forming Apparatus>

Figure 1:
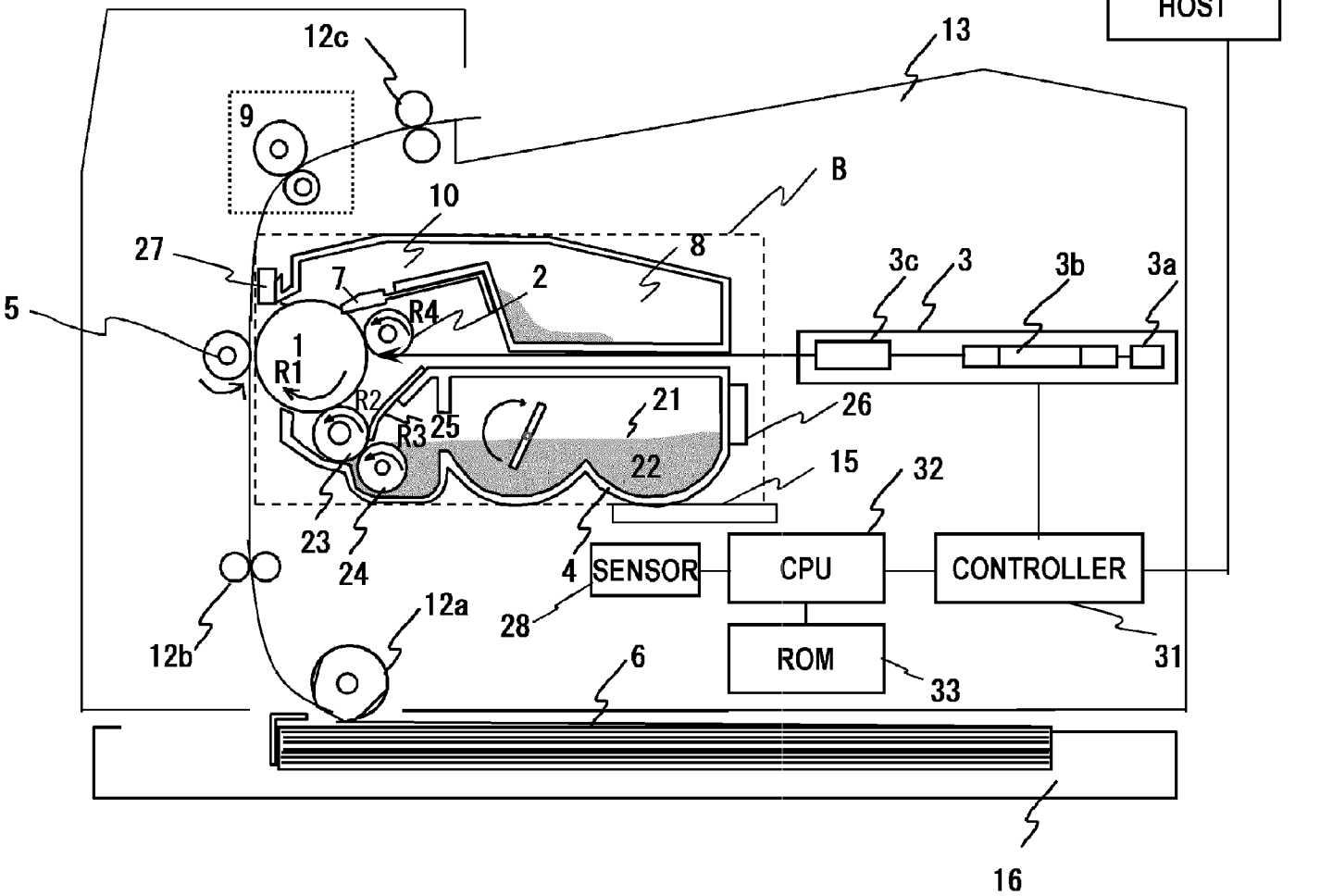
FIG. 1 is a sectional view showing a schematic configuration of an image forming apparatus according to a practical example of the present invention.
Figure 2:
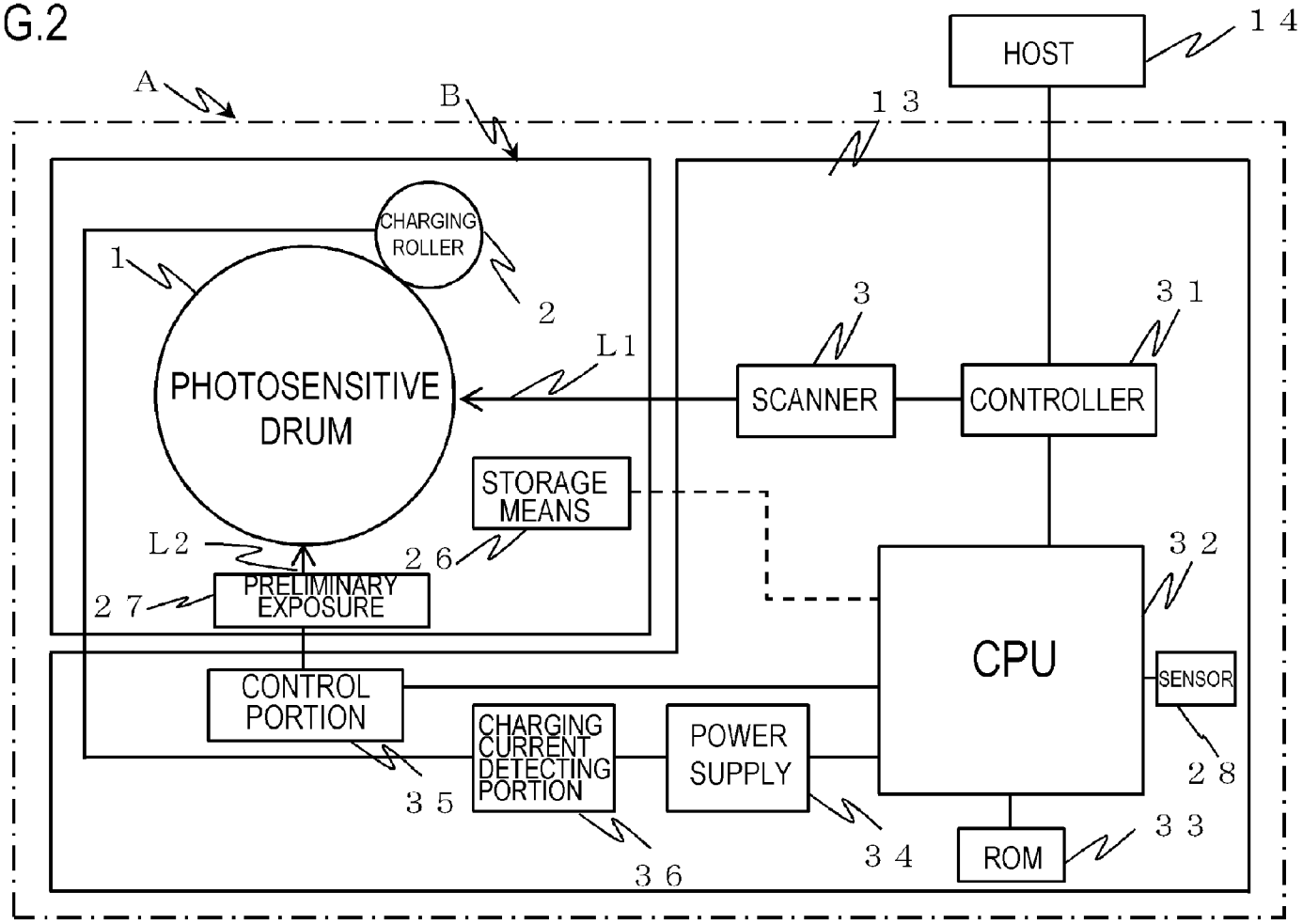
FIG. 2 is a control block diagram of an image forming apparatus according to a practical example of the present invention.

A schematic configuration of an image forming apparatus according to a practical example of the present invention will be described with reference to FIGS. 1 and 2. FIG. 1 is a schematic sectional view showing a schematic configuration of an image forming apparatus according to a practical example of the present invention. FIG. 2 is a control block diagram of an image forming apparatus according to a practical example of the present invention. Examples of an image forming apparatus A according to the present practical example includes a laser beam printer which forms an image on, for example, a recording medium (recording material) 6 that is a sheet of recording paper, an OHP sheet, or the like with an electrophotographic system in accordance with image information. In addition, as will be described in detail later, with the image forming apparatus A according to the present practical example, a process cartridge B is configured to be attachable and detachable to and from an apparatus main body of the image forming apparatus A. In this case, the apparatus main body refers to a constituent portion excluding the cartridge B in the image forming apparatus A. Moreover, while an image forming apparatus configured such that a toner image (a developer image) formed on a photosensitive drum is directly transferred onto recording material as a transferred body will be described in the present practical example, a configuration of an image forming apparatus is not limited thereto. For example, the present invention can also be applied to an image forming apparatus (such as a color laser printer) which forms a color toner image by superimposing and transferring toner images of respectively different colors formed by a plurality of image forming portions onto an intermediate transfer member as a transferred body and transferring the color toner image onto recording material.

The image forming apparatus A is used connected to a host 14 that is a personal computer or the like. A controller portion 31 forms an electrostatic latent image (an electrostatic image) on a photosensitive drum 1 by processing a print signal (a print request signal and image data) from the host 14 and controlling a scanner 3 that is exposing means. In other words, the image forming apparatus A forms an image on recording material based on a print signal. The image forming apparatus A includes a cylindrical photosensitive drum 1 which is rotationally driven in a direction of an arrow R1 in the drawing as an image bearing body (a rotating body). In the present practical example, the photosensitive drum 1 is an electrophotographic photosensitive member created by applying an organic photo conductor (OPC) layer with a film thickness of 24 μm as a photosensitive layer around an aluminum cylinder that is a cylindrical base. A minimum photosensitive member film thickness at which the photosensitive drum 1 can maintain favorable image quality is 9 μm, at which point the photosensitive member reaches an end of its product life.

The photosensitive drum 1 is uniformly charged by a roller-like charging member which is charging means and which is pressed against and brought into contact with the photosensitive drum 1 or, in other words, by a DC contact charging roller (a charging roller) 2. In the present practical example, the charging roller 2 is configured such that a conductive rubber layer is provided on a metal core. As will be described in detail later, in the present practical example, DC voltage fixed to a prescribed value is applied as a charging bias to the charging roller 2 from a power supply 34 and uniformly negatively charges a surface of the photosensitive drum 1. The charging roller 2 is driven so as to rotate in a direction of an arrow R4 in the drawing by a rotation of the photosensitive drum 1. The charging roller 2 is in contact with approximately an entire length of the photosensitive drum 1 in a longitudinal direction thereof (a direction perpendicular to a conveyance direction of a recording medium 6). When viewing the photosensitive drum 1 in an axial direction thereof, a contact portion between the charging roller 2 and the photosensitive drum 1 with respect to a circumferential direction of the surface of the circular photosensitive drum 1 will be referred to as a charging position.

The uniformly-charged photosensitive drum 1 is exposed by laser light L1 from a scanner 3 that is exposing means (a first exposing unit) and an electrostatic latent image is formed on the surface of the photosensitive drum 1. The scanner 3 includes a laser light source 3*a*, a polygonal mirror 3*b*, a lens system 3*c*, and the like and is capable of performing scanning exposure on the photosensitive drum 1 under control of the controller portion 31. The present practical example uses a latent image setting of Vd=−500 V and Vl=−100 V regardless of film thickness of the photosensitive member. When viewing the photosensitive drum 1 in an axial direction thereof, a position where the laser light L1 is irradiated to the photosensitive drum 1 with respect to the circumferential direction of the surface of the circular photosensitive drum 1 will be referred to as an exposure position.

Subsequently, the electrostatic latent image is visualized as a toner image as developer is supplied by a developing apparatus 4. In other words, the developing apparatus 4 includes a developer container 21 housing a negatively-charging non-magnetic toner (a toner) 22 as a single-component developer. In the present practical example, in order to achieve a smaller particle size and a lower melting point and to improve transfer efficiency, an approximately spherical toner with a weight average particle size of approximately 7 μm is used as the toner 22.

A part of the developer container 21 opposing the photosensitive drum 1 is opened along approximately the entire length of the photosensitive drum 1 in the longitudinal direction and a developing roller 23 that is a roller-like developer bearing body (developing means) is arranged in the opening. The developing roller 23 is pressed against and brought into contact with the photosensitive drum 1 positioned above left in the drawing with respect to the developing apparatus 4 so that there is a prescribed amount of penetration and is rotationally driven in a direction of an arrow R2 in the drawing. In addition, a surface of the developing roller 23 has adequate irregularities so as to increase probability of rubbing with respect to the toner 22 and to enable conveyance of the toner 22 to be performed in a preferable manner.

An elastic roller 24 is brought into contact with the developing roller 23 from lower right in the drawing as means for supplying developer to the developing roller 23 and scraping off undeveloped toner from the developing roller 23. The elastic roller 24 is rotatably supported by the developer container 21. In addition, a rubber sponge roller is used as the elastic roller 24 for the purposes of supplying toner to the developing roller 23 and providing the ability to scrape off undeveloped toner and is rotationally driven in a direction of an arrow R3 in the drawing which is the same direction as the developing roller 23. Furthermore, the developing apparatus 4 includes a developing blade 25 as a developer layer restricting member which restricts an amount of toner to be borne by the developing roller 23. The developing blade 25 is configured by an elastic metal thin plate made of SUS and is provided so that a vicinity of a tip on a free end-side comes into surface contact with an outer circumferential surface of the developing roller 23. Toner borne on the developing roller 23 due to rubbing with the elastic roller 24 is imparted with a charge due to frictional charging and restricted to a thin layer when passing a contact portion with the developing blade 25.

In the developing apparatus 4 configured as described above, a DC voltage fixed to a prescribed value is applied to the developing roller 23 as a developing bias. In the present practical example, the developing bias is set constant to Vdc=−300 V regardless of film thickness of the photosensitive member. Accordingly, in the present practical example, an exposed portion where a negative charge has attenuated on the surface of the uniformly-charged photosensitive drum 1 is developed by reversal development. When viewing the photosensitive drum 1 in the axial direction thereof, a contact portion between the developing roller 23 and the photosensitive drum 1 with respect to the circumferential direction of the surface of the circular photosensitive drum 1 will be referred to as a developing position.

Meanwhile, the recording medium 6 is separately fed by a supply roller 12*a* or the like from a recording medium housing portion 16 and temporarily stops at a resist roller 12*b*. The resist roller 12*b* synchronizes a recording position of the recording medium 6 with formation timing of a toner image on the photosensitive drum 1 and sends out the recording medium 6 to an opposing portion (a transfer portion) of a transfer roller 5 that is transfer means and the photosensitive drum 1. A visualized toner image on the photosensitive drum 1 is transferred to the recording medium 6 by an action of the transfer roller 5. When viewing the photosensitive drum 1 in the axial direction thereof, a contact portion between the transfer roller 5 and the photosensitive drum 1 with respect to the circumferential direction of the surface of the circular photosensitive drum 1 will be referred to as a transfer position.

The recording medium 6 onto which the toner image has been transferred is conveyed to a fixing apparatus 9. At this point, an unfixed toner image on the recording medium 6 is permanently fixed to the recording medium 6 by heat and pressure. Subsequently, the recording medium 6 is discharged to the outside of the machine by a discharge roller 12*c* or the like.

Meanwhile, the photosensitive drum 1 after transferring the toner image to the recording medium 6 is subjected to full-surface exposure (full-surface light irradiation) by laser light L2 emitted by a preliminary exposing apparatus (a second exposing unit) 27 that is preliminary exposing means. Accordingly, potential of the photosensitive drum surface having become nonuniform due to a previous formed image is uniformly averaged. In other words, the photosensitive drum surface is irradiated by light so as to remove charge remaining on the photosensitive drum surface. The preliminary exposing apparatus 27 (a preliminary exposing portion) is arranged on a downstream side in a rotational direction of the photosensitive drum than the transfer roller 5 and on an upstream side in the rotational direction of the photosensitive drum than the charging roller 2 and exposes the surface of the photosensitive drum after passing the transfer position and before arriving at the charging position. An LED, a halogen lamp, or the like can be used as a light source of the preliminary exposing means. While the light source used is not particularly limited, an LED is favorably used from the perspectives of low drive voltage and easiness of downsizing of the apparatus. In the present practical example, an LED is used as a preliminary exposure light source. When viewing the photosensitive drum 1 in the axial direction thereof, a portion where the photosensitive drum 1 is irradiated by light from the preliminary exposing apparatus 27 with respect to the circumferential direction of the surface of the circular photosensitive drum 1 will be referred to as a preliminary exposure position.

In addition, transfer residual toner which remains on the photosensitive drum 1 without being transferred is cleaned by cleaning means (a cleaner) 10. Specifically, the cleaner 10 scrapes off transfer residual toner from the photosensitive drum 1 with a cleaning blade 7 that is a cleaning member and stores the transfer residual toner in a waste toner container 8. The cleaned photosensitive drum 1 is repetitively used for image formation in a similar manner to that described above.

In the present practical example, the image forming apparatus A adopts a process cartridge system in which an electrophotographic photosensitive member as an image bearing body and processing means that acts on the image bearing body are integrated into a cartridge which is configured to be attachable to and detachable from an apparatus main body. In this case, processing means includes charging means which charges the electrophotographic photosensitive member, developing means which supplies developer to the electrophotographic photosensitive member, and cleaning means which cleans the electrophotographic photosensitive member. In other words, a process cartridge is configured as follows. Charging means, developing means, cleaning means, and an electrophotographic photosensitive member are integrated into a cartridge and the cartridge is configured to be attachable to and detachable from an apparatus main body. Alternatively, at least one of charging means, developing means, and cleaning means, and an electrophotographic photosensitive member maybe integrated into a cartridge and the cartridge maybe configured to be attachable to and detachable from an apparatus main body. Alternatively, at least developing means and an electrophotographic photosensitive member may be integrated into a cartridge and the cartridge may be configured to be attachable to and detachable from an apparatus main body.

In the present practical example, the photosensitive drum 1, the charging roller 2, the developing apparatus 4, and the cleaner 10 are integrated into a cartridge to constitute the process cartridge B which is configured to be attachable to and detachable from an apparatus main body 13. The process cartridge B is detachably mounted to the apparatus main body 13 via mounting means 15 provided on the apparatus main body 13. In addition, the recording medium supply roller 12*a*, the resist roller 12*b*, the discharge roller 12*c*, and the like described above constitute recording medium conveying means which conveys the recording medium 6 with respect to the process cartridge B and which discharges the recording medium 6 after image formation from the apparatus main body 13.

In the present practical example, the process cartridge B is provided with storage means 26 (a storage portion). The storage means 26 may take any form such as a contact nonvolatile memory, a non-contact nonvolatile memory, and a volatile memory having a power supply. In the present practical example, a non-contact nonvolatile memory 26 is mounted to the process cartridge B as the storage means. The non-contact nonvolatile memory 26 has an antenna (not shown) which is memory-side information transmitting means and enables information to be read and written by wirelessly communicating with control means (a CPU) 32 provided in the image forming apparatus main body 13. In the present practical example, the CPU 32 is equipped with functions of apparatus main body-side information transmitting means and reading/writing means of information in the memory 26. The storage means 26 stores information related to a photosensitive member film thickness of the photosensitive drum 1, information on the charging roller 2, and information related to use environment to be described later.

In the configuration described above, components such as the power supply 34, the control portion (the control unit) 35, and the CPU 32 which are involved in applying voltage to the charging roller 2 correspond to a voltage applying portion according to the present invention.

<Abnormal Discharge Phenomenon>

Abnormal discharge is a phenomenon in which, when DC voltage is applied to the charging roller 2, charged potential is overcharged by an over-discharge which occurs at a long gap portion on an upstream side in the rotational direction of the photosensitive drum 1 with respect to a nip which is formed by the charging roller 2. In other words, the overcharged region of the photosensitive drum 1 charged by the over-discharge is an overcharged region charged by the charging roller 2 in a state where a charging current equal to or greater than a desired value had flowed. Since charged potential in the overcharged region is in an overcharged state, potential (Vl) after exposure is also unstable and results in an abnormally discharged image with a mesh-like pattern. In the long gap portion, as charging bias to the charging roller is increased, normal discharge which had been weak and temporally continuous dramatically changes to intermittent discharge which is both temporally and spatially discontinuous and which has a large discharge current. This abnormal discharge is conceivably categorized as a Townsend discharge during normal discharge. A Townsend discharge is a discharge phenomenon which varies depending on types of an electric field and gases between electrodes, gas pressure, and electrode materials.

A proximity discharge phenomenon in the atmosphere occurs according to Paschen's law. This phenomenon is a diffusion phenomenon of an electron avalanche in which a process where an electric field accelerates free electrons and the accelerated free electrons collide with either molecules existing between electrodes or the electrodes to generate electrons and positive and negative ions takes place repetitively. The electron avalanche diffuses in accordance with the electric field and the diffusion determines an ultimate amount of discharged charge. With an electric field being more excessive than conditions in accordance with Paschen's law, an intense localized discharge or, in other words, an abnormal discharge is more likely to occur.

This abnormal discharge phenomenon is likely to occur in the following conditions. Under low temperature and low humidity, since fewer molecules exist between electrodes as compared to under normal temperature and normal humidity, discharge start voltage tends to be higher than discharge start voltage derived from Paschen's law. Since higher discharge start voltage increases the likelihood of an electric field more excessive than conditions in accordance with Paschen's law, an abnormal discharge is more likely to occur under low temperature and low humidity.

In addition, an abnormal discharge is likely to occur when film thickness of the photosensitive drum 1 is large. A larger film thickness reduces capacitance and, consequently, an amount of charged charge Q necessary for a desired charged potential Vd decreases. When collision of electrons causes an avalanche of ionization and an exponential increase in the number of charged particles results in an air breakdown and causes a large current to flow at once, a charged potential of the photosensitive drum 1 is estimated to assume an overcharged state due to an amount of accumulated charge exceeding a necessary amount. Moreover, intensive research carried out by the present inventors has revealed that an abnormal discharge is more likely to occur when a film thickness of a photosensitive layer (an OPC layer) is larger than 21 μm and occurs more prominently when the film thickness is equal to or larger than 22 μm.

Furthermore, an abnormal discharge is likely to occur when resistance of the charging roller 2 is low. When a discharge current flows through a roller with low resistance, shared voltage of the roller becomes lower relative to a roller with high resistance. The lower shared voltage of the roller relatively increases shared voltage of an air layer (a gap portion) and, consequently, a discharge current that flows to the photosensitive drum 1 increases as compared to a roller with high resistance. Therefore, compared to a roller with high resistance, a roller with low resistance enables an abnormal discharge to occur at lower start voltage and, conceivably, an abnormal discharge is more likely to occur. In other words, an abnormal discharge is dependent on a charging capability of a charging roller.

Moreover, in some cases, the likelihood of occurrence of an abnormal discharge may increase due to a change in surface potential of the photosensitive drum 1 before and after being charged by the charging roller 2. Specifically, when there is a large a difference in potential between a surface potential of the photosensitive drum 1 immediately before charging by the charging roller 2 (hereinafter, pre-charging potential) and surface potential of the photosensitive drum 1 immediately after charging, intensity of an electric field of the air layer (a gap portion) increases and an amount of discharge current increases and, consequently, an abnormal discharge is more likely to occur. In order to uniformly average the potential of the surface of the photosensitive drum 1 having become nonuniform due to a previous formed image, the preliminary exposing apparatus 27 performs full-surface exposure of the surface of the photosensitive drum 1 before charging by the charging roller 2. Therefore, a configuration in which preliminary exposure is performed has a larger difference in potential between pre-charging potential and charged potential as compared to a configuration in which preliminary exposure is not performed.

In addition, since the difference in potential between pre-charging potential and charged potential (surface potential of the photosensitive drum 1 immediately after charging) increases as charged potential Vd rises, the greater the charging bias applied to the charging roller 2, the higher the likelihood of an occurrence of an abnormal discharge.

<State of Occurrence of Abnormal Discharge>

Figure 3B:
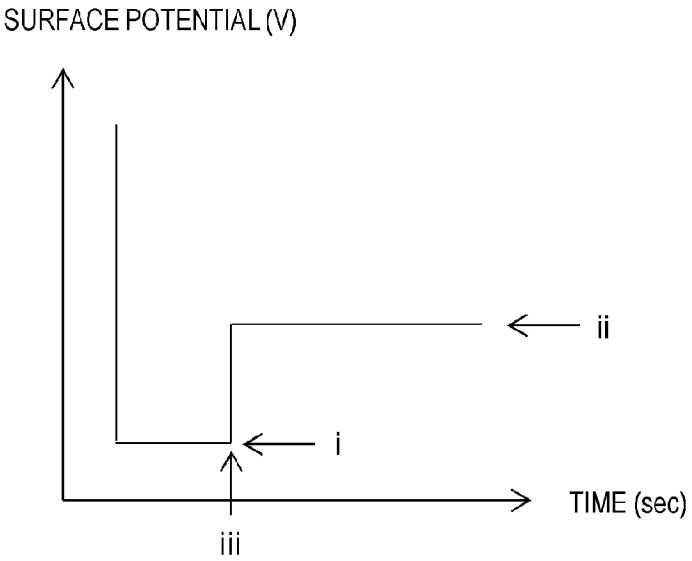
FIGS. 3A and 3B are explanatory diagrams of timings of occurrences of abnormal discharge.
Figure 3A:
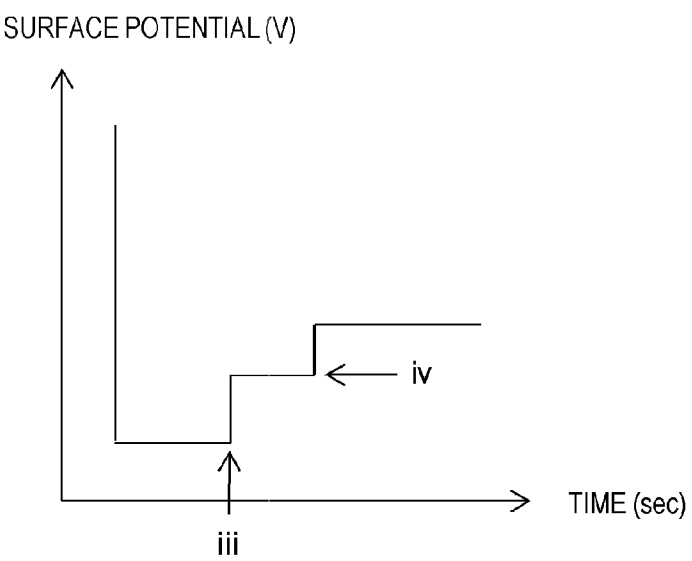

FIGS. 3A and 3B show a time transition of surface potential of the photosensitive drum 1 at the developing position. FIG. 3A shows a state where an abnormal discharge has occurred and FIG. 3B shows a state where an abnormal discharge has not occurred. When a print signal is input, a forward rotation operation starts, the photosensitive drum 1 rotates, and a charging bias is applied. Potential i denotes charged potential of the photosensitive drum 1 when a charging bias is applied. Potential ii denotes the charged potential Vd of the photosensitive drum 1 after irradiation by the preliminary exposing apparatus 27. Timing iii denotes timing at which irradiation by the preliminary exposing apparatus 27 is started. In the present practical example, from the perspective of extending product life, irradiation by the preliminary exposing apparatus 27 is normally started immediately before image exposure in order to minimize the irradiation time of the preliminary exposing apparatus 27. In other words, in the present practical example, when performing image formation based on a print signal, a charging bias is applied to the photosensitive drum 1 to perform charging and, subsequently, light irradiation is started by the preliminary exposing apparatus 27 on the surface of the charged photosensitive drum 1. Therefore, timing ts at which charging of a portion of the photosensitive drum 1 exposed by the preliminary exposing apparatus 27 is initially started by the charging roller 2 is determined by the timing iii at which irradiation by the preliminary exposing apparatus 27 is started. In other words, the timing ts is a timing at which a period Tpc required by a prescribed point on the surface of the photosensitive drum 1 to move from the preliminary exposure position to the charging position has lapsed from the timing iii. The period Tpc is a value determined by a rotational speed of the photosensitive drum 1.

As shown in FIG. 3, when an abnormal discharge occurs, surface potential in a region of the photosensitive drum 1 subjected to preliminary exposure immediately after start of irradiation by the preliminary exposing apparatus 27 is higher than Vd and an overcharge occurs (iV). Subsequently, the abnormal discharge converges with the passage of time and becomes normal charged potential Vd. When the photosensitive drum 1 is exposed in an overcharged state, potential (Vl) after exposure is also unstable and results in an abnormally discharged image with a mesh-like pattern. On the other hand, when an abnormal discharge does not occur, since the desired charged potential Vd is attained even immediately after the start of irradiation by the preliminary exposing apparatus 27, an abnormally discharged image does not occur.

Therefore, when an abnormal discharge occurs, the occurrence of an abnormally discharged image can be prevented in advance by starting exposure once the normal charged potential Vd is attained after the abnormal discharge ends. While the occurrence of an abnormally discharged image can be avoided by uniformly extending a preliminary exposure lighting period prior to image formation to a period in which an abnormally discharged image does not occur, a trade-off is created between a longer preliminary exposure period and abrasion of the drum and the like. In consideration thereof, more specifically, by detecting an abnormal discharge period and either quickening the start of irradiation by the preliminary exposing apparatus 27 or delaying the start of exposure only when an abnormal discharge has occurred, a longer product life can be realized while avoiding the occurrence of an abnormally discharged image.

<Method of Detecting Abnormal Discharge Period>

Next, a method of detecting an abnormal discharge period (a duration of an abnormal discharge (an overcharged state)) will be described. In the present practical example, an abnormal discharge period is calculated (acquired) using information related to a film thickness of the photosensitive drum 1 and information related to use environment. In the present practical example, components related to the acquisition of an abnormal discharge period correspond to an acquiring portion according to the present invention.

Figure 4:
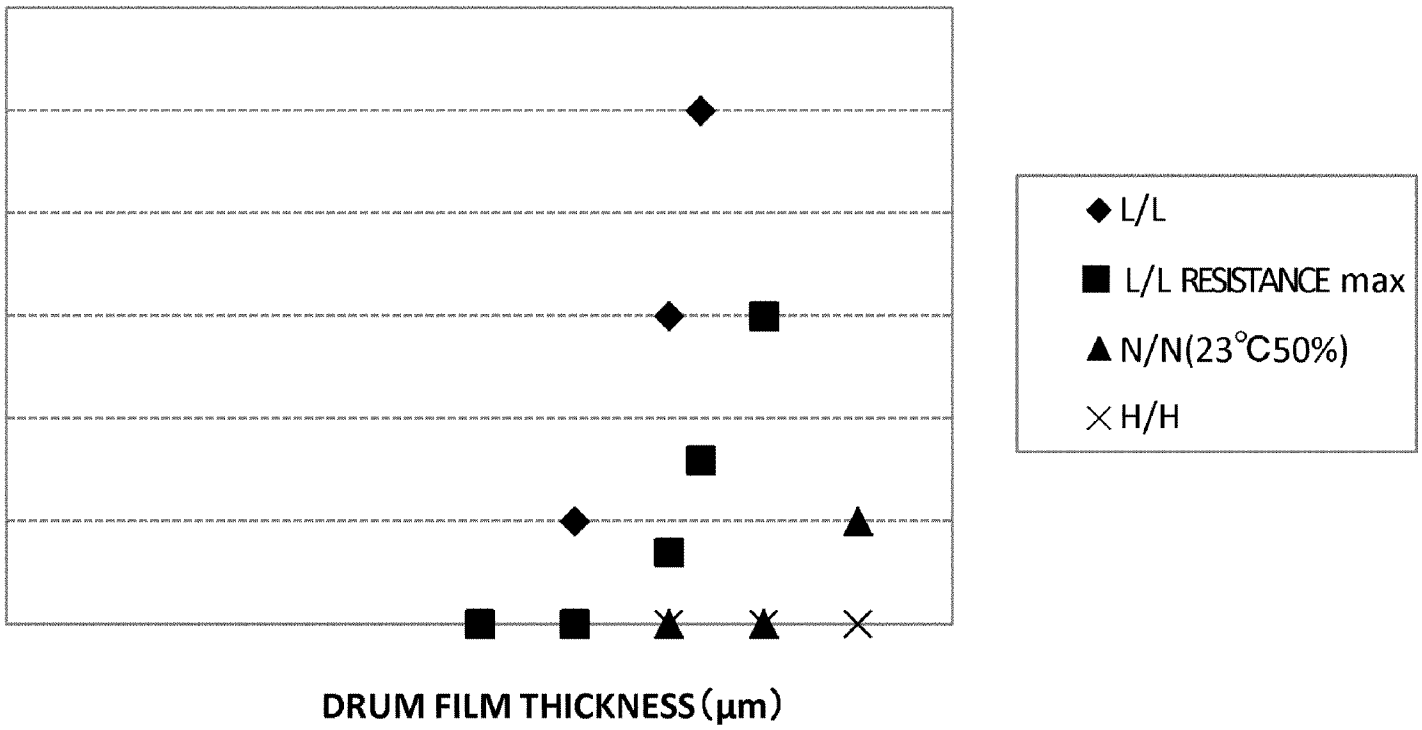
FIG. 4 is a diagram illustrating a correlation between film thickness of a photosensitive member and the environment with respect to an abnormal discharge period.

FIG. 4 is a graph showing how a maximum abnormal discharge period changes in accordance with different film thicknesses of the photosensitive drum 1 and different use environment (temperature and humidity). Moreover, charged potential is Vd=−500 V. The graph shows that, while an abnormal discharge does not occur in a high temperature, high humidity environment (H/H) of 30° C. and 80%, an abnormal discharge occurs in a low temperature, low humidity environment (L/L) of 15° C. and 10%. It is also shown that, in a low temperature, low humidity environment (L/L), the larger the film thickness of the photosensitive drum 1, the more abnormal discharges occur, and the larger the film thickness, the longer the abnormal discharge period. Furthermore, the lower the resistance value of the charging roller 2, the longer the abnormal discharge period.

In consideration thereof, based on these pieces of measured data (a relationship between an abnormal discharge period and film thickness of the photosensitive drum and a relationship between an abnormal discharge period and use environment), an approximation curve for calculating an abnormal discharge period is obtained and the data is stored in an image forming apparatus main body-side ROM 33 in advance. Since the resistance value of the charging roller 2 includes a certain amount of variation due to its manufacturing process, in the present practical example, a result of a charging roller with a lowest resistance value among the variation has been adopted. An abnormal discharge period can be calculated by adopting data on the approximation curve stored in the ROM 33 which corresponds to the information related to the film thickness of the photosensitive drum 1 and the information on temperature and humidity which are stored in the storage means 26. Moreover, while methods of obtaining an approximation curve include statistical methods such as linear approximation, exponential approximation, polynomial approximation, cumulative approximation, and moving average approximation, no particular restrictions apply and an optimal method can be used as appropriate.

<Information Related to Film Thickness of Photosensitive Drum 1 and Information Related to Use Environment>

Information related to the film thickness of the photosensitive drum 1 is calculated according to the following method. As described earlier, the film thickness of a photosensitive member decreases as discharges causes the surface of the photosensitive drum 1 to deteriorate and the surface of the photosensitive drum 1 is scraped off due to passing of the recording medium 6 (passage of paper) or the cleaning member 7 coming into contact with the surface. With the image forming apparatus A according to the present practical example, the decrease of photosensitive member film thickness with respect to the photosensitive drum 1 is correlated with a charging bias application period. In turn, the charging bias application period is proportional to the number of sheets subjected to image formation. Therefore, the rate of decrease of the photosensitive member film thickness with respect to the photosensitive drum 1 may be expressed as a linear function of the number of sheets subjected to image formation.

Information related to use environment is calculated according to the following method. The image forming apparatus A according to the present practical example includes an environment sensor (temperature and humidity sensor) 28 as environment detecting means in the apparatus main body and detects a temperature P and humidity Q every prescribed time and rewrites information related to use environment in the storage means 26. In the present practical example, the storage means 26 mounted to the process cartridge B stores the number of sheets subjected to image formation (P) as information related to photosensitive member film thickness and temperature and humidity as information related to use environment. In addition, using the two pieces of information, an abnormal discharge period is calculated according to the method described earlier and a period from the start of irradiation by the preliminary exposing apparatus 27 to the start of image exposure is varied. Moreover, examples of information related to photosensitive member film thickness other than the number of sheets subjected to image formation described above include the number of rotations of the photosensitive drum 1, the number of passed sheets (the number of sheets of recording material having passed through the image forming apparatus), and a charging period (a charging bias application period) and any piece of information may be selected.

<Method of Controlling Interval Between Start of Irradiation by Preliminary Exposing Apparatus and Start of Exposure by Scanner>

Figure 5:
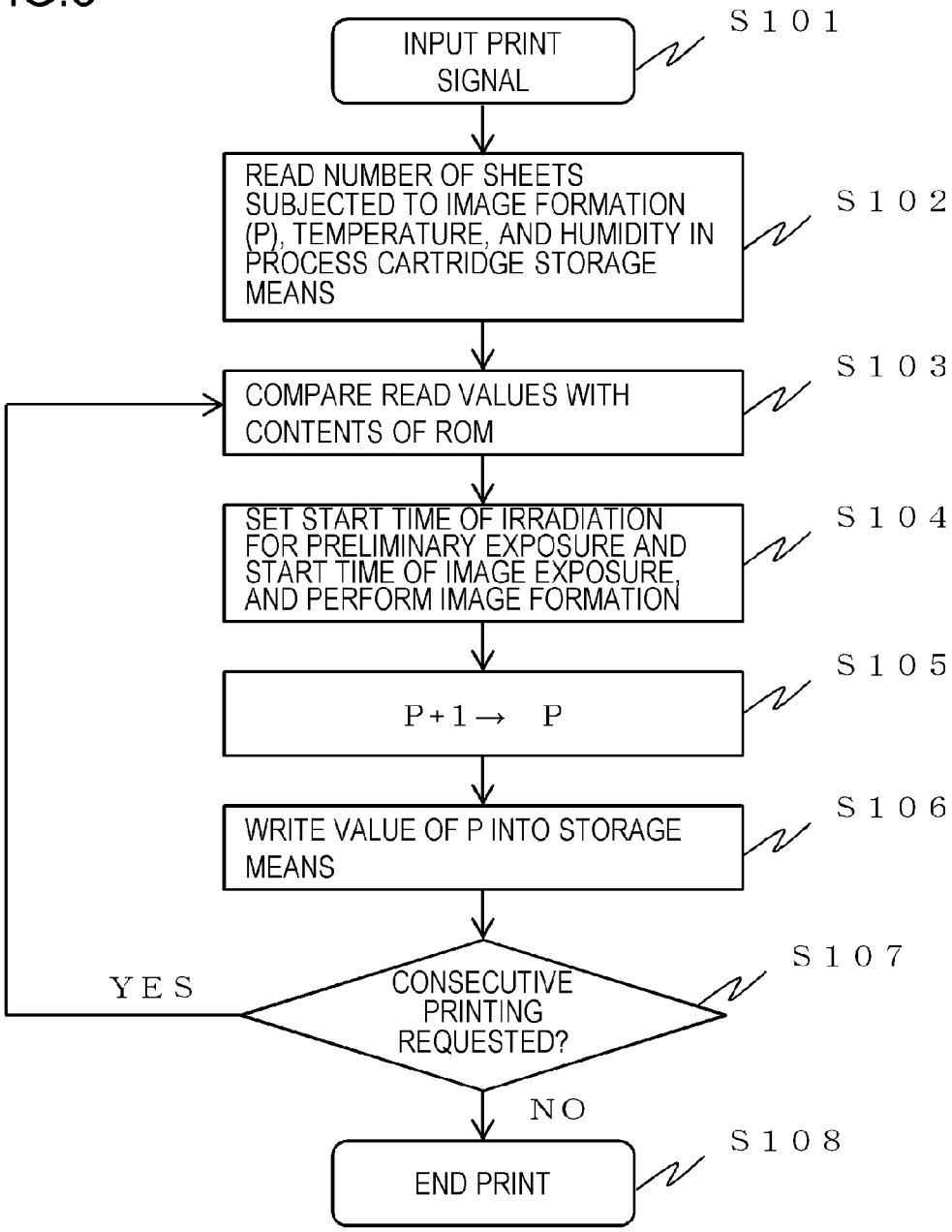
FIG. 5 is a flow chart of control upon start of preliminary exposure according to a first practical example of the present invention.

Referring to the flow chart shown in FIG. 5, a method of varying the period between the start of irradiation by the preliminary exposing apparatus 27 and the start of exposure by the scanner 3 (the exposing portion) will now be described. The process cartridge B is equipped with the storage means 26 and the storage means 26 stores the number of sheets subjected to image formation performed using the process cartridge B as well as temperature and humidity. When a print signal is input from the host 14 (S101), the CPU 32 communicates with the storage means 26 mounted to the process cartridge B and reads the number of sheets subjected to image formation (P), temperature, and humidity in the process cartridge B (S102). Next, the CPU 32 compares contents of the image forming apparatus main body-side ROM 33 in which abnormal discharge periods in accordance with the number of sheets subjected to image formation, temperature, and humidity have been stored in advance with the values of the number of sheets subjected to image formation (P), the temperature, and the humidity read into the CPU 32 as described above (S103). Subsequently, the CPU 32 sets a start time of irradiation by the preliminary exposing apparatus 27 and a start time of image exposure by the scanner 3 using the control portion 35 which controls a period from the start of irradiation by the preliminary exposing apparatus 27 to the start of exposure by the scanner 3 and makes a transition to an image formation operation (S104).

Figure 6:
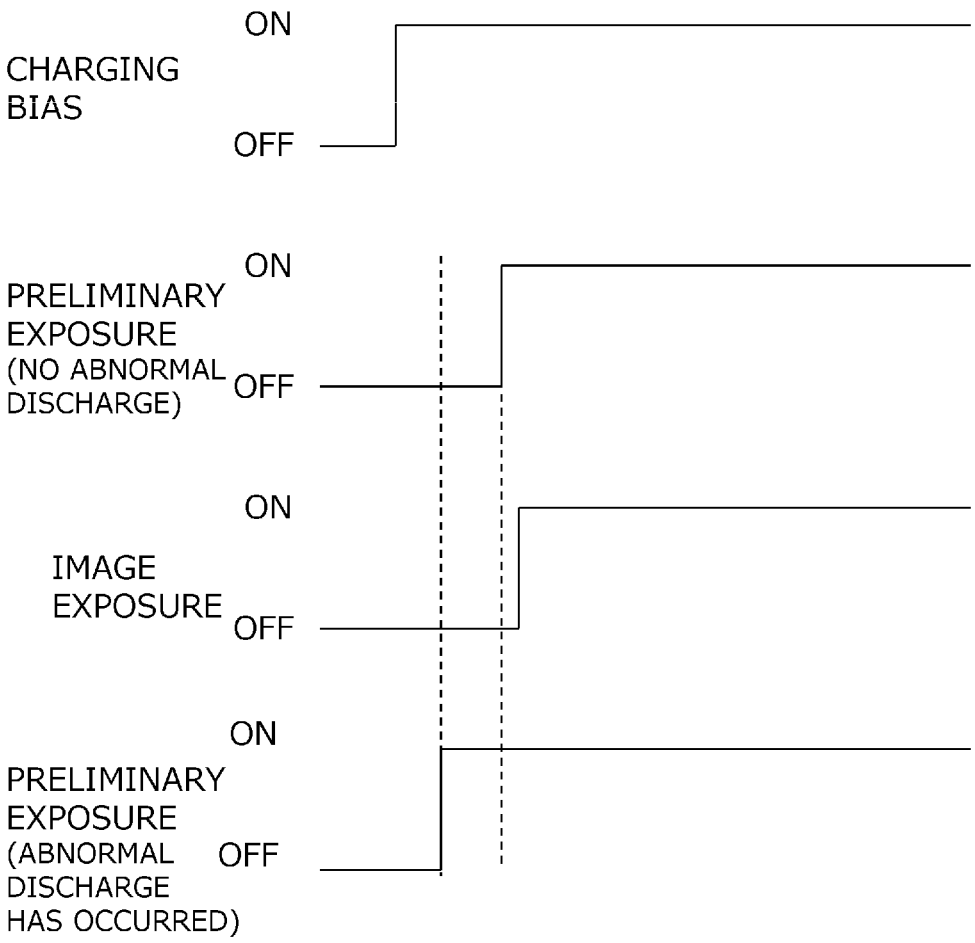
FIG. 6 is a timing chart upon start of preliminary exposure according to the first practical example of the present invention.

FIG. 6 is a timing chart from the start of irradiation by the preliminary exposing apparatus 27 (first timing=timing t1) to the start of image exposure by the scanner 3 (second timing=timing t2). See FIGS. 15 and 16A-16B, which illustrate more comprehensive timing charts. When an image formation operation is started based on the reception of a print signal from the host 14, the photosensitive drum 1 rotates and a prescribed charging bias is applied. Subsequently, the preliminary exposing apparatus 27 starts irradiation and the scanner 3 starts image exposure (latent image formation). When an abnormal discharge has not occurred, the preliminary exposing apparatus 27 starts irradiation immediately before the scanner 3 starts image exposure. Since the preliminary exposing apparatus 27 is arranged on a further upstream side in the rotational direction of the photosensitive drum 1 than a position of image exposure by the scanner 3, an irradiation timing of the preliminary exposing apparatus 27 occurs earlier than an image exposure timing of the scanner 3 by an amount corresponding to a distance between a preliminary exposure position and an exposure position. On the other hand, when an abnormal discharge has occurred, the image exposure start time of the scanner 3 is fixed and the start of irradiation by the preliminary exposing apparatus 27 is advanced by the abnormal discharge period. In other words, the timing of start of irradiation by the preliminary exposing apparatus 27 is changed so that the start time of image exposure by the scanner 3 occurs after the timing at which the abnormal discharge ends (third timing=timing t3). Accordingly, a latent image can be formed in a region on an upstream side of an overcharged region on the surface of the photosensitive drum 1 with respect to a movement direction of the surface of the photosensitive drum 1 without forming a latent image in the overcharged region which has been charged by an abnormal discharge of the surface of the photosensitive drum 1.

Changing the timing at which irradiation by the preliminary exposing apparatus 27 is started is equivalent to changing the timing ts at which charging of a portion of the photosensitive drum 1 exposed by the preliminary exposing apparatus 27 is initially started by the charging roller 2. Therefore, by controlling the start time of irradiation by the preliminary exposing apparatus 27 and the start time of image exposure by the scanner 3, the control portion 35 controls a period (a first period) from the timing ts at which charging of a portion of the photosensitive drum 1 exposed by the preliminary exposing apparatus 27 is initially started by the charging roller 2 to a timing at which the scanner 3 starts forming a latent image. When such control is performed, the control unit sets the first period as follows. Specifically, referring to FIGS. 16A-16B, assuming that the control portion 35 sets the first period to Δt1 so that a latent image is not formed in the overcharged region when a length of an abnormal discharge period (a second period) is T1 (where Tx=T1), the control portion 35 sets the first period to Δt2 that is longer than Δt1 so that a latent image is not formed in the overcharged region when a length of an abnormal discharge period (the second period) is T2 (where Tx=T2) that is longer than T1.

Moreover, when an abnormal discharge occurs, the timing ts at which charging of a portion of the photosensitive drum 1 exposed by the preliminary exposing apparatus 27 is initially started by the charging roller 2 is a timing at which an occurrence of abnormal discharge starts.

When the image formation operation ends, the counted number of sheets subjected to image formation is increased by one (S105) and the counted number of sheets subjected to image formation in the storage means 26 of the process cartridge B is rewritten (S106). Next, a determination is made on whether consecutive printing has been requested (S107) and a transition is made to a print ending operation when no such request has been made (S108). However, when such a request has been made, the operations of S103 to S107 are repeated until there are no more requests for consecutive printing.

Figure 15:
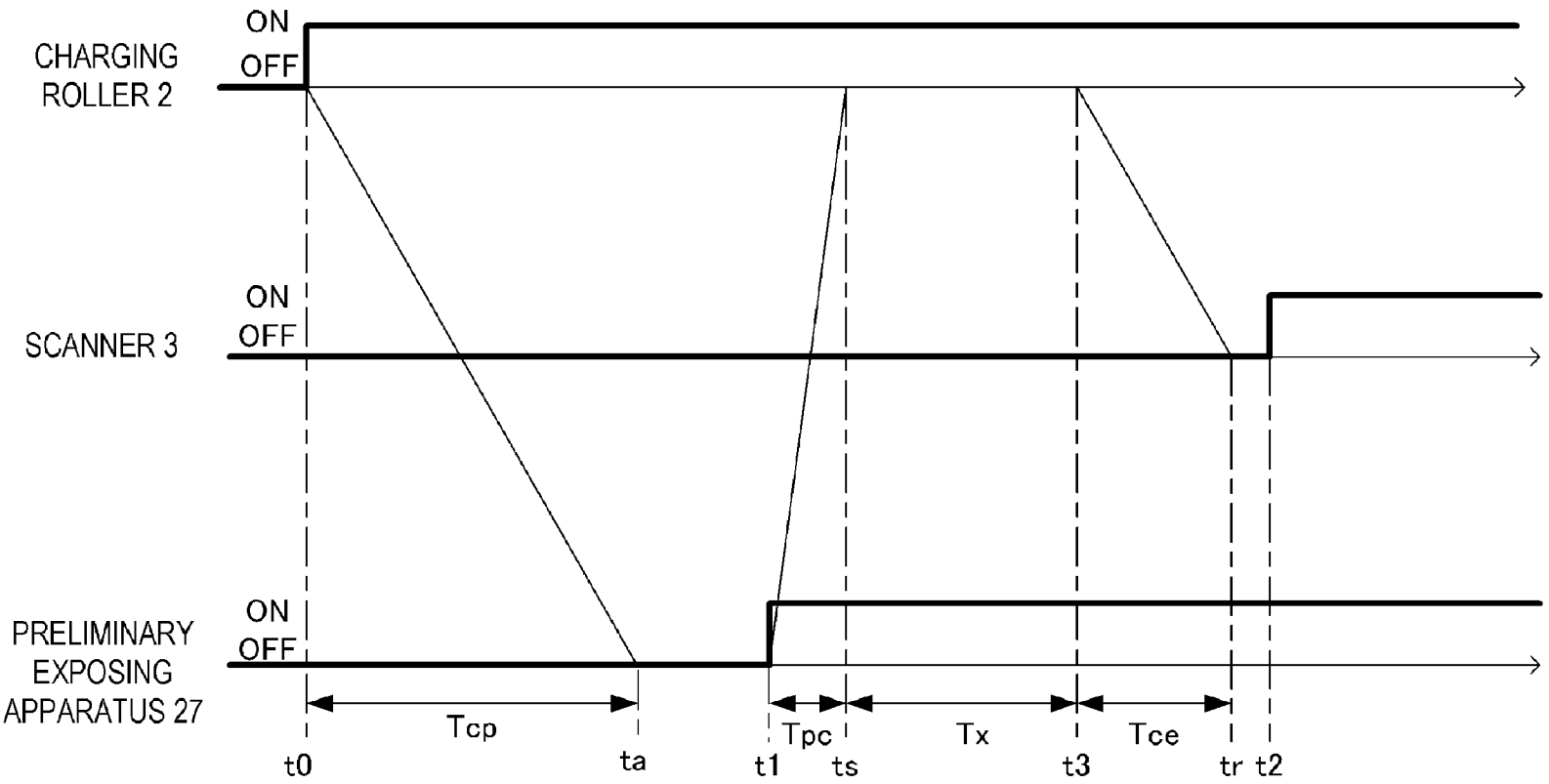
FIG. 15 is a timing chart showing timing control according to the present invention.

Control from the start of charging based on reception of a print signal to the formation of a latent image in the image formation operation (S104) described above will now be described using the timing chart shown in FIGS. 15 and 16A-16B. In FIGS. 15 and 16A-16B, a horizontal axis represents time, a non-charging state of the charging roller 2 is denoted by OFF and a charging state of the charging roller 2 is denoted by ON, a state where a latent image is not being formed by the scanner 3 is denoted by OFF and state where a latent image is being formed by the scanner 3 is denoted by ON, and an non-irradiating state of the preliminary exposing apparatus 27 is denoted by OFF and an irradiating state of the preliminary exposing apparatus 27 is denoted by ON.

When charging by the charging roller 2 starts at timing to, a tip of a charged region of the photosensitive drum 1 reaches the preliminary exposure position at timing to after the lapse of a period Tcp during which a prescribed point on the surface of the photosensitive drum 1 moves from the charging position to the preliminary exposure position. Subsequently, when irradiation by the preliminary exposing apparatus 27 starts at timing t1, a tip of a preliminary exposed region of the photosensitive drum 1 reaches the charging position at timing ts after the lapse of a period Tpc during which the prescribed point on the surface of the photosensitive drum 1 moves from the preliminary exposure position to the charging position. An abnormal discharge occurs at the timing ts at which charging of a portion of the photosensitive drum 1 exposed by the preliminary exposing apparatus 27 is initially started by the charging roller 2. The abnormal discharge occurs only for a period Tx and the abnormal discharge no longer occurs (ends) at timing t3. In addition, a rear end of the region overcharged by the abnormal discharge (a portion of the photosensitive drum 1 at the charging position at the timing t3) reaches an exposure position at timing tr after the lapse of a period Tce during which the prescribed point on the surface of the photosensitive drum 1 moves from the charging position to the exposure position. Subsequently, the scanner 3 starts forming a latent image at timing t2. In this manner, the control portion 35 controls the timing t2 so that the timing t2 occurs after the timing tr. Moreover, the period Tcp, the period Tpc, and the period Tce are all values determined by the rotational speed of the photosensitive drum 1.

<Confirmation of Effect>

In order to confirm the effect of the present practical example, 50,000 sheets were subjected to image formation using the image forming apparatus A according to the present practical example controlled as described above and image forming apparatuses according to first and second comparative examples not subjected to control according to the present practical example but subjected to conventional control instead. The image forming apparatuses were compared with respect to the occurrence of abnormally discharged images and the presence or absence of stripes which are image defects attributable to abrasion of a photosensitive drum. Confirmation was performed in a low temperature, low humidity environment (temperature 15° C., humidity 10%) in which an abnormal discharge is likely to occur and abrasion of the photosensitive drum 1 occurs more readily.

The following two comparative examples were used as the comparative examples: a first comparative example configured so that irradiation by the preliminary exposing apparatus 27 starts immediately before image exposure by the scanner 3; and a second comparative example configured so that, compared to the first comparative example, the start of irradiation by the preliminary exposing apparatus 27 always precedes the start of image exposure by the scanner 3 by a constant time interval T. The time interval T was set to a maximum abnormal discharge period in a low temperature, low humidity environment in which an abnormal discharge is most likely to occur.

TABLE 1

| | OCCURRENCES OF ABNORMALLY DISCHARGED IMAGE | OCCURRENCES OF STRIPES |
|---|---|---|
| FIRST PRACTICAL EXAMPLE | NO | NO |
| FIRST COMPARATIVE EXAMPLE | YES | NO |
| SECOND COMPARATIVE EXAMPLE | NO | YES |

Table 1 presents a result of the comparative experiment described above by comparing the present practical example with conventional examples. As is apparent from Table 1, when performing the control in accordance with the present practical example, no abnormally discharged images occurred and favorable results were obtained through an extended period of use regardless of the number of sheets subjected to image formation. In addition, there were no occurrences of stripes due to abrasion of the photosensitive drum. On the other hand, with the first comparative example, although there were no occurrences of stripes due to abrasion of the photosensitive drum, an abnormally discharged image occurred. In addition, with the second comparative example, although there were no occurrences of abnormally discharged images, stripes occurred due to abrasion of the photosensitive drum.

As described above, according to the present practical example, by optimizing a period between the start of irradiation by the preliminary exposing apparatus 27 and the start of image exposure by the scanner 3 in accordance with a length of an abnormal discharge period, product life can be increased while avoiding the occurrence of an abnormally discharged image through an extended period of use. An abnormal discharge period can be acquired based on the number of sheets subjected to image formation which is one type of information related to photosensitive member film thickness of the photosensitive drum 1 and temperature and humidity as information related to the use environment. These pieces of information are stored in the storage means 26 mounted to the process cartridge.

In the present practical example, while an abnormal discharge period is detected and the start of irradiation by the preliminary exposing apparatus 27 (timing t1) is advanced only when an abnormal discharge has occurred, a method of time adjustment is not limited thereto. For example, since it suffices to extend the period from the start of irradiation by the preliminary exposing apparatus 27 to the start of image exposure by the scanner 3, the start time of irradiation by the preliminary exposing apparatus 27 may be fixed and the time of start of image exposure by the scanner 3 (timing t2) may be delayed. Alternatively, control may be performed so that a desired time interval can be secured by advancing the start time of irradiation by the preliminary exposing apparatus 27 (timing t1) and delaying the time of start of image exposure by the scanner 3 (timing t2). In other words, the period (the first period) from the timing ts at which charging of a portion of the photosensitive drum 1 exposed by the preliminary exposing apparatus 27 is initially started by the charging roller 2 to timing at which the scanner 3 starts forming a latent image need only be controlled so that a latent image is not formed in an overcharged region of the photosensitive drum 1.

Moreover, in the present practical example, the storage means 26 is provided in the process cartridge B. Accordingly, the process cartridge itself is enabled to retain information regarding photosensitive member film thickness and information on temperature and humidity. Therefore, for example, even when the process cartridge B which has not reached its product life is replaced with respect to the apparatus main body 13, information related to photosensitive member film thickness, temperature, and humidity can be always recognized in conformance to each process cartridge B, which is extremely advantageous. However, modes to which the present invention is applicable are not limited to this mode. The principles of the present invention can also be applied when storage means is provided in an apparatus main body to produce similar effects to the present practical example.

In addition, the present invention is also applicable to configurations in which an image forming apparatus does not adopt a process cartridge system to produce similar effects to the present practical example. In this case, storage means is provided in an apparatus main body to store information related to photosensitive member film thickness, temperature, and humidity. In addition, for example, when a photosensitive drum is individually replaced, the information related to photosensitive member film thickness, temperature, and humidity in the storage means may be reset, for instance.

Furthermore, as described earlier, the higher the charged potential Vd, the higher the likelihood of an occurrence of an abnormal discharge. While the latent image setting according to the present practical example is Vd=−500 V regardless of the film thickness of a photosensitive layer of a photosensitive member, in cases where the charged potential Vd varies depending on a period of use, the abnormal discharge period may be corrected in accordance with the charged potential Vd. In addition, while an abnormal discharge period is calculated (acquired) using two types of information including information related to the film thickness of the photosensitive drum 1 and information related to use environment in the present practical example, the abnormal discharge period may be calculated based only on any one type of information. Furthermore, instead of a method of directly calculating an abnormal discharge period, a charging current flowing through the charging roller 2 or the like may be measured and the period between the start of irradiation by the preliminary exposing apparatus 27 and the start of image exposure by the scanner 3 may be varied based on a period in which the current exceeds a prescribed range.

SECOND PRACTICAL EXAMPLE

An abnormal discharge period depends on a resistance value of the charging roller 2. As described earlier, the lower the resistance value of the charging roller 2, the longer the abnormal discharge period, and the higher the resistance value of the charging roller 2, the shorter the abnormal discharge period. In consideration thereof, in a second practical example of the present invention, an abnormal discharge period is calculated based on information related to a charging capability of the charging roller 2 in addition to information related to the film thickness of the photosensitive drum 1 and information related to the use environment. Otherwise, the second practical example is the same as the first practical example and, accordingly, a description of configurations of the second practical example that are similar to those of the first practical example will be omitted.

The charging capability of the charging roller 2 is correlated to the resistance value of the charging roller 2. Since a resistance value varies due to extended use, the resistance value is proportional to a charging bias application period, an integrated charging current amount (an integrated value of amounts of current flowing through the charging roller), or the like. A resistance value also varies in accordance with temperature and humidity. In the present practical example, a resistance value of the charging roller 2 when brand new is stored in the storage means 26.

In the present practical example, an approximation curve is obtained based on a relationship between an abnormal discharge period and film thickness of the photosensitive drum, a relationship between an abnormal discharge period and a resistance value of the charging roller, and a relationship between an abnormal discharge period and use environment, and data thereof is stored in the image forming apparatus main body-side ROM 33 in advance. An abnormal discharge period is calculated by adopting data on the approximation curve stored in the ROM 33 that corresponds to the information related to the film thickness of the photosensitive drum 1, the information on temperature and humidity, and the resistance value of the charging roller which are stored in the storage means 26.

As described above, according to the present practical example, the number of sheets subjected to image formation which is one type of information related to photosensitive member film thickness of the photosensitive drum 1, temperature and humidity, and a resistance value of the charging roller 2 are stored in the storage means 26 mounted to the process cartridge B. Since a period between the start of irradiation by the preliminary exposing apparatus 27 and the start of image exposure by the scanner 3 is optimized in correspondence with the information stored in the storage means 26, product life can be increased while avoiding the occurrence of an abnormally discharged image through an extended period of use.

Moreover, in the present practical example, a resistance value when the charging roller 2 is brand new is adopted as information related to the charging capability of the charging roller 2 to calculate an abnormal discharge period. Methods of using information related to the charging capability of the charging roller 2 are not limited thereto and, for example, an abnormal discharge period may be corrected based on information such as a charging bias application period, an integrated charging current amount, temperature, humidity, and the like in further consideration of variation in the resistance value due to extended use and environmental variation.

THIRD PRACTICAL EXAMPLE

In a third practical example of the present invention, a charging current flowing through the charging roller 2 is measured and the period between the start of irradiation by the preliminary exposing apparatus 27 and the start of image exposure by the scanner 3 is varied based on a period in which the measured current value exceeds a prescribed range. In the third practical example, descriptions of configurations in common with those of the first and second practical examples will be omitted. Matters not described in the third practical example are similar to those described in the first and second practical examples.

<Method of Detecting Abnormal Discharge Period>

In the present practical example, a charging current flowing through the charging roller 2 is measured and an abnormal discharge period is calculated (acquired) based on the measured charging current value. In order to measure a charging current flowing through the charging roller 2, as shown in FIG. 2, the present practical example includes a charging current detecting portion 36. As a signal is sent from the CPU 32, the charging current detecting portion 36 detects a charging current value while applying DC voltage to the charging roller 2.

Figure 7:
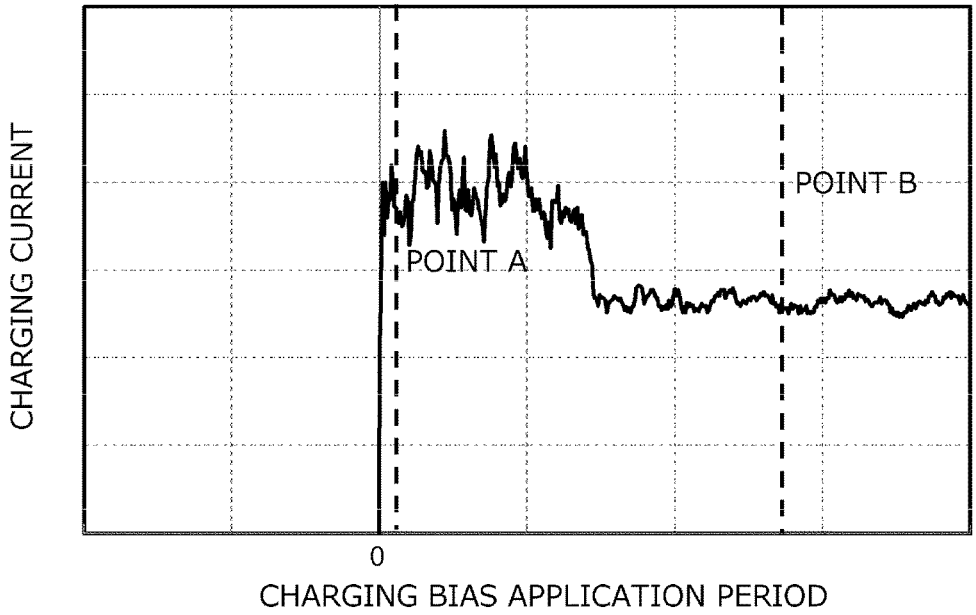
FIG. 7 is a diagram showing a time transition of a charging current.

FIG. 7 is a diagram showing a time transition of a charging current value when an abnormal discharge occurs. The charging current value becomes larger than a normal value due to an abnormal discharge immediately after a charging bias is applied but the abnormal discharge gradually converges and the charging current value returns to the normal value.

Figure 8:
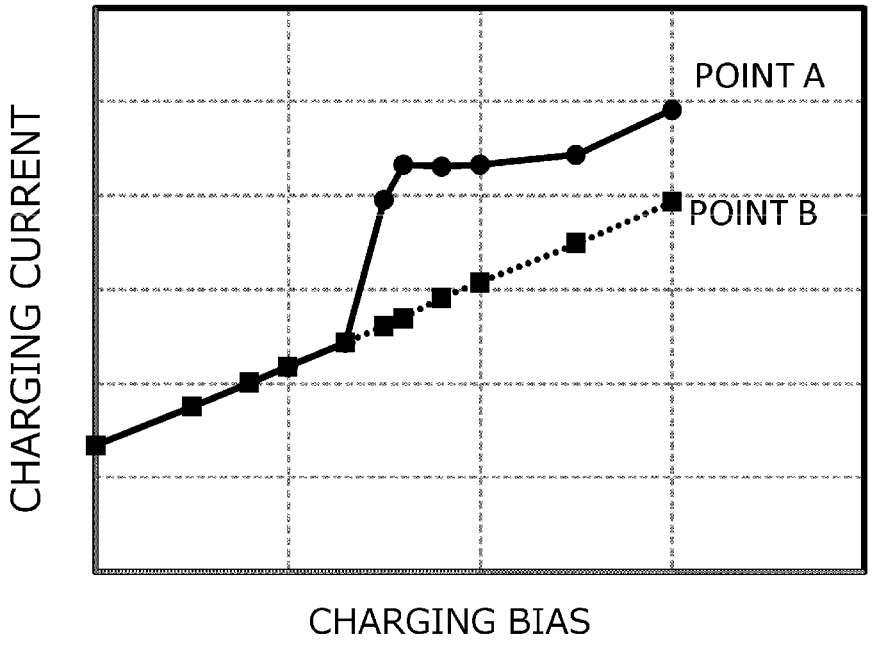
FIG. 8 is a relationship diagram between a charging current and a charging bias.

FIG. 8 is a diagram showing a relationship between a charging current value and a charging bias at a point A immediately after the application of the charging bias illustrated in FIG. 7. At point A, when the charging bias increases, the charging current value increases in a manner resembling that of a phase transition due to an abnormal discharge at a specific bias value. In addition, FIG. 8 also shows a relationship between a charging current value and a charging bias at a point B illustrated in FIG. 7. At point B, the abnormal discharge has converged and the charging current value is normal. At point B, the charging bias and the charging current are in a linear relationship. In addition, this is consistent with a straight line of a charging bias that is equal to or lower than a bias at which the abnormal discharge occurs at point A. These features reveal a relationship between a normal charging current and a charging bias from a measurement point at point A with a lower bias than a bias at which an abnormal discharge occurs.

In the present practical example, an approximation line is drawn from the measurement of two points where the charging bias value is equal to or lower than a bias at which an abnormal discharge occurs at point A (immediately after application of charging bias) and a charging current value obtained from the approximation line is adopted as a normal charging current value. Methods of obtaining an approximation line are not limited thereto and an approximation line need only be obtained from two or more measurement points, and accuracy can be enhanced by increasing the number of measurement points. In addition, a normal charging current value under a desired charging bias can be discerned from a relationship between a normal charging current and a charging bias.

An abnormal discharge period can be calculated by comparing a value of a charging current flowing through the charging roller 2 when a charging bias is applied during image formation with a value of a charging current flowing through the charging roller 2 during a normal discharge.

Figure 9:
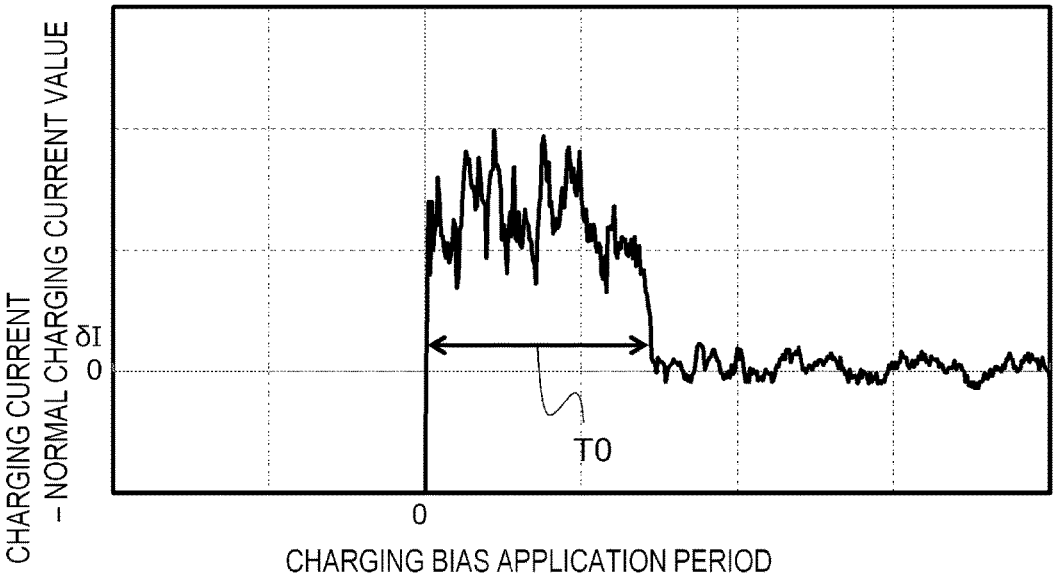
FIG. 9 is an explanatory diagram of a time transition of a value obtained by subtracting a normal charging current value from a charging current value.

FIG. 9 shows a time transition of a value as a result of subtracting a normal charging current value obtained by an approximation line from a value of a charging current that flows when a desired charging bias is applied. In the present practical example, a period (fifth timing) required by the charging current value to fall within a prescribed current value (within a threshold range) (δI) from a point of application of a charging bias (fourth timing) is determined as an abnormal discharge period (T0). Moreover, while a charging current Ic that flows through the charging roller 2 is detected in the present practical example, a transfer current or a drum ground current may be measured instead. An abnormal discharge period is calculated according to this method and a period from the start of irradiation by the preliminary exposing apparatus 27 to the start of image exposure by the scanner 3 is varied.

<Method of Controlling Interval Between Start of Irradiation by Preliminary Exposing Apparatus and Start of Exposure by Scanner>

Figure 10:
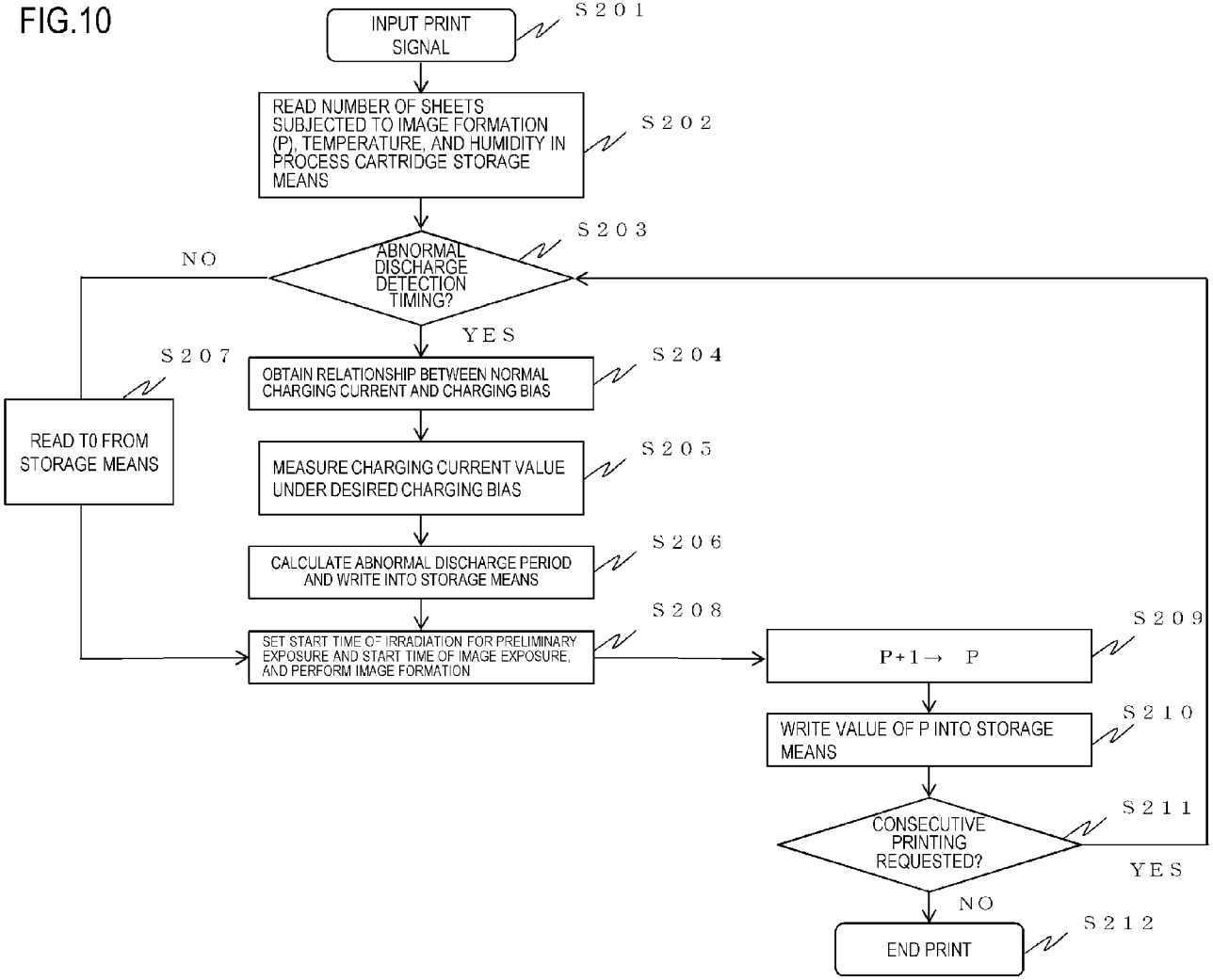
FIG. 10 is a flow chart of control upon start of preliminary exposure according to a third practical example of the present invention.

Referring to the flow chart shown in FIG. 10, a method of control from the start of irradiation by the preliminary exposing apparatus 27 to the start of image exposure by the scanner 3 according to the present practical example will now be described. The process cartridge B is equipped with the storage means 26 and the storage means 26 stores the number of sheets subjected to image formation (P) performed using the process cartridge B as well as temperature and humidity. When a print signal is input from the host 14 (S201), the CPU 32 communicates with the storage means 26 mounted to the process cartridge B and reads the number of sheets subjected to image formation (P), temperature, and humidity in the process cartridge B (S202).

Next, the CPU 32 checks whether a timing at which the abnormal discharge period T0 is to be detected has arrived (S203). In S203, whether temperature and humidity are within thresholds determined in advance and whether the number of sheets subjected to image formation (P) matches a prescribed number of sheets determined in advance are checked. In the present practical example, detection timings of a 0th sheet and once every 2000 sheets are adopted as detection timings based on the number of sheets and detection timings of points at which an absolute moisture content as calculated from the temperature and humidity varies by ±1 g/m$^3$ from a previous detection value are adopted as detection timings based on temperature and humidity. However, detection timings are not limited thereto and the timings may be appropriately set based on a product life of the image forming apparatus, a charging capability of the charging roller 2, or the like.

Detection timing arrives when the temperature or humidity exceeds the threshold or when a prescribed number of sheets determined in advance is matched, in which case detection of a charging current is performed and a relationship between a normal charging current and a charging bias is obtained (S204). Next, a charging current value under a desired charging bias is measured (S205), and the abnormal discharge period T0 is calculated (acquired) by comparing a value of a charging current that flows when the desired charging bias is applied with a charging current value during a normal discharge and stored in a storage portion (S206). In addition, when the prescribed number of sheets determined in advance is not matched and, at the same time, the temperature and humidity are within the thresholds, the abnormal discharge period T0 is read in from the storage means (S207). Subsequently, based on the value of the abnormal discharge period T0, a start time of irradiation by the preliminary exposing apparatus 27 and a start time of image exposure by the scanner 3 are set by the control portion 35 which controls a period from the start of irradiation by the preliminary exposing apparatus 27 to the start of image exposure by the scanner 3 and a transition is made to an image formation operation (S208).

In this case, when setting a period from the start of irradiation by the preliminary exposing apparatus 27 to the start of image exposure by the scanner 3 based on the value of the abnormal discharge period T0, a variation of the abnormal discharge period within the thresholds of temperature and humidity must be taken into consideration. In the present practical example, a maximum amount of variation of the abnormal discharge period in a case where an absolute moisture content varies by 1 g/m$^3$ is obtained in advance based on a relationship among the photosensitive drum 1 in a state of initial film thickness, an absolute moisture content of the charging roller 2 with a minimum resistance value among a variation of values, and the abnormal discharge period. Based on a value obtained by adding the maximum amount of variation to the abnormal discharge period T0, a period from the start of irradiation by the preliminary exposing apparatus 27 to the start of image exposure by the scanner 3 is set.

When the image formation operation ends, the counted number of sheets subjected to image formation is increased by one (S209) and the counted number of sheets subjected to image formation in the storage means 26 of the process cartridge B is rewritten (S210). Next, a determination is made on whether consecutive printing has been requested (S211) and a transition is made to a print ending operation when no such request has been made (S212). However, when such a request has been made, the operations of S203 to S211 are repeated until there are no more requests for consecutive printing.

As described above, according to the present practical example, a charging current flowing through the charging roller 2 is detected and an abnormal discharge period can be calculated based on the detected charging current value. Accordingly, in a similar manner to the first and second practical examples, a period between the start of irradiation by the preliminary exposing apparatus 27 and the start of image exposure by the scanner 3 can be optimized and product life can be increased while avoiding the occurrence of an abnormally discharged image.

FOURTH PRACTICAL EXAMPLE

A fourth practical example of the present invention differs in configuration from the third practical example described above in a method of controlling an interval between the start of irradiation by the preliminary exposing apparatus 27 and the start of exposure by the scanner 3. Specifically, in the fourth practical example, a determination is not made regarding whether or not an abnormal discharge period is to be detected as is the case of the third practical example and an abnormal discharge period is acquired during execution of an image formation operation. Other configurations are similar to those of the third practical example described above. Matters not described in the fourth practical example are similar to those described in the first to third practical examples.

<Method of Controlling Interval Between Start of Irradiation by Preliminary Exposing Apparatus and Start of Exposure by Scanner>

Figure 11:
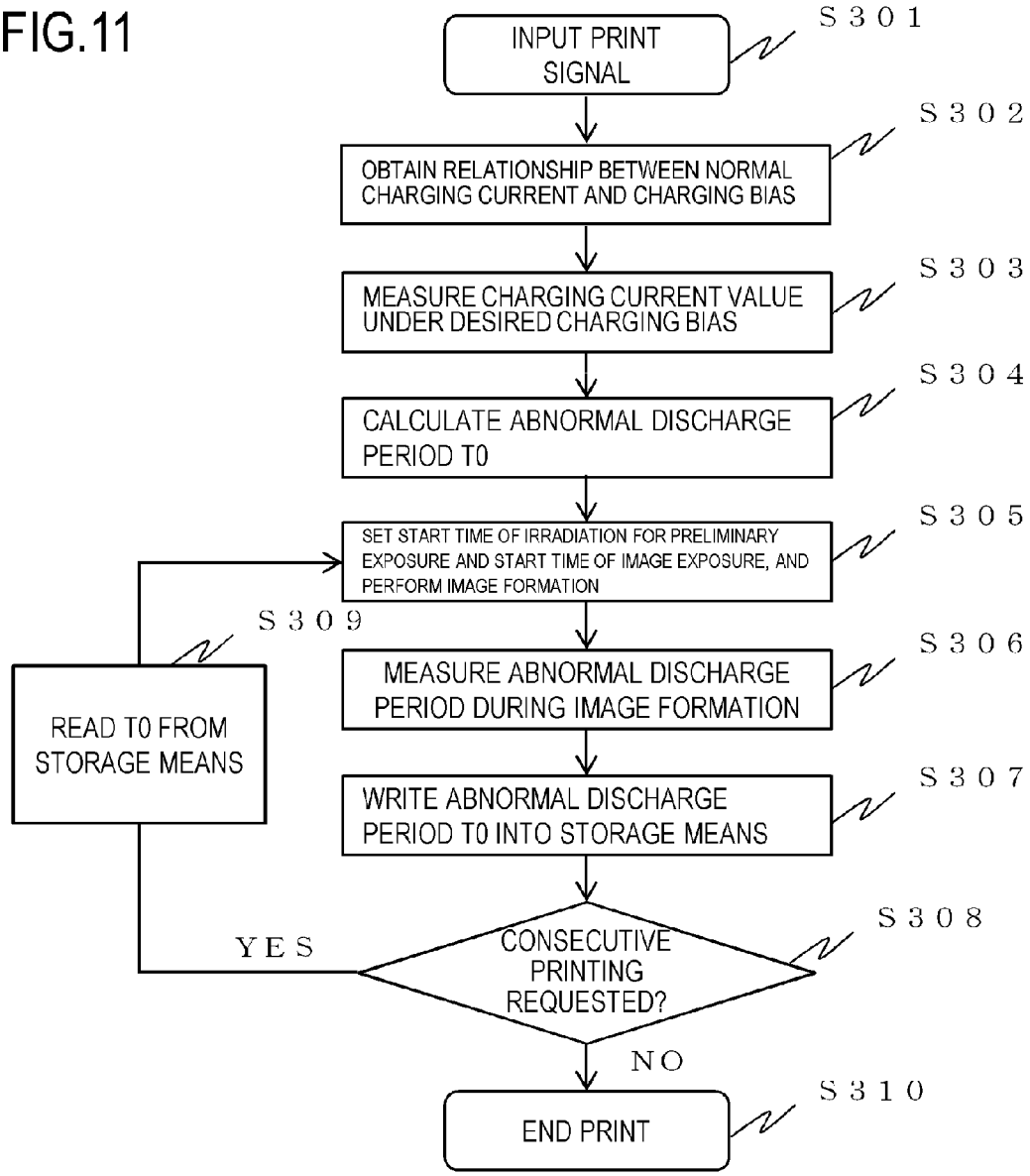
FIG. 11 is a flow chart of control upon start of preliminary exposure according to a fourth practical example of the present invention.

Control for avoiding an abnormally discharged image according to the fourth practical example of the present invention will now be described with reference to the flowchart shown in FIG. 11. In the present practical example, a period from the start of irradiation by the preliminary exposing apparatus 27 to the start of exposure by the scanner 3 is varied as follows.

When a print signal is input from the host 14 (S301), detection of a charging current is performed to obtain a relationship between a normal charging current and a charging bias (S302). Next, a charging current value under a desired charging bias is measured (S303) and the abnormal discharge period T0 is calculated by comparing a value of a charging current that flows when the desired charging bias is applied with a charging current value during a normal discharge (S304). Subsequently, based on the value of the abnormal discharge period T0, the control portion 35 sets a start time of irradiation by the preliminary exposing apparatus 27 and a start time of image exposure by the scanner 3 and a transition is made to an image formation operation (S305).

As shown in FIG. 6, when an image formation operation is started, the photosensitive drum 1 rotates and a prescribed charging bias is applied. Subsequently, the preliminary exposing apparatus 27 starts irradiation and the scanner 3 starts image exposure. When an abnormal discharge has not occurred, the preliminary exposing apparatus 27 starts irradiation immediately before the scanner 3 starts image exposure. Since the preliminary exposing apparatus 27 is arranged on a further upstream side in the rotational direction of the photosensitive drum 1 than an image exposure position of the scanner 3, an irradiation start timing of the preliminary exposing apparatus 27 occurs earlier than an image exposure start timing of the scanner 3 by an amount corresponding to a distance between a preliminary exposure position and an exposure position. On the other hand, when an abnormal discharge has occurred, the image exposure start time of the scanner 3 is fixed and the start of irradiation by the preliminary exposing apparatus 27 is advanced by the abnormal discharge period.

At this point, in the present practical example, the charging current detecting portion section 36 which detects a charging current flowing through the charging roller 2 monitors a charging current from the start of irradiation for preliminary exposure to the end of the image formation operation and measures a period (an abnormal discharge period) until the charging current value returns to a normal value (S306). When the image formation operation ends, the abnormal discharge period T0 in the storage means 26 of the process cartridge B is rewritten (S307). Next, a determination is made on whether consecutive printing has been requested (S308). When such a request has been made, the abnormal discharge period T0 is read from the storage means (S309) and the operations of S305 to S309 are repeated until there are no more requests for consecutive printing. When no such request is made, a transition is made to a print ending operation (S310).

As described above, according to the present practical example, a charging current flowing through the charging roller 2 is detected, an abnormal discharge period is calculated based on a period of a variation range where the current value exceeds a prescribed range, and a period between the start of irradiation by the preliminary exposing apparatus 27 and the start of image exposure by the scanner 3 is optimized based on the calculated abnormal discharge period. Accordingly, an occurrence of an abnormally discharged image can be avoided.

In the present practical example, while an abnormal discharge period is detected and the start of irradiation by the preliminary exposing apparatus 27 is advanced only when an abnormal discharge has occurred, a method of time adjustment is not limited thereto. For example, since it suffices to extend the period from the start of irradiation by the preliminary exposing apparatus 27 to the start of image exposure by the scanner 3, the start time of irradiation by the preliminary exposing apparatus 27 may be fixed and the time of start of image exposure by the scanner 3 may be delayed. Alternatively, control may be performed so that a desired time interval can be secured by advancing the start time of irradiation by the preliminary exposing apparatus 27 and delaying the time of start of image exposure by the scanner 3. Moreover, since the photosensitive drum 1 rotates at a constant speed, performing time adjustment means that the number of rotations (or a travel distance) by the photosensitive drum 1 between a timing of start of preliminary exposure and a timing of start of image exposure varies.

FIFTH PRACTICAL EXAMPLE

The abnormal discharge period T0 can also be detected during consecutive printing (while image formation is being consecutively performed on a plurality of sheets of recording material). In a fifth practical example of the present invention, detection of an abnormal discharge period is sequentially performed during consecutive printing and the detection values are used to sequentially vary a period from the start of irradiation by the preliminary exposing apparatus 27 to the start of image exposure by the scanner 3. In the fifth practical example, descriptions of configurations in common with those of the respective practical examples described above will be omitted. Matters not described in the fifth practical example are similar to those of the practical examples described above.

<Method of Controlling Interval Between Start of Irradiation for Preliminary Exposure and Start of Exposure>

Figure 12:
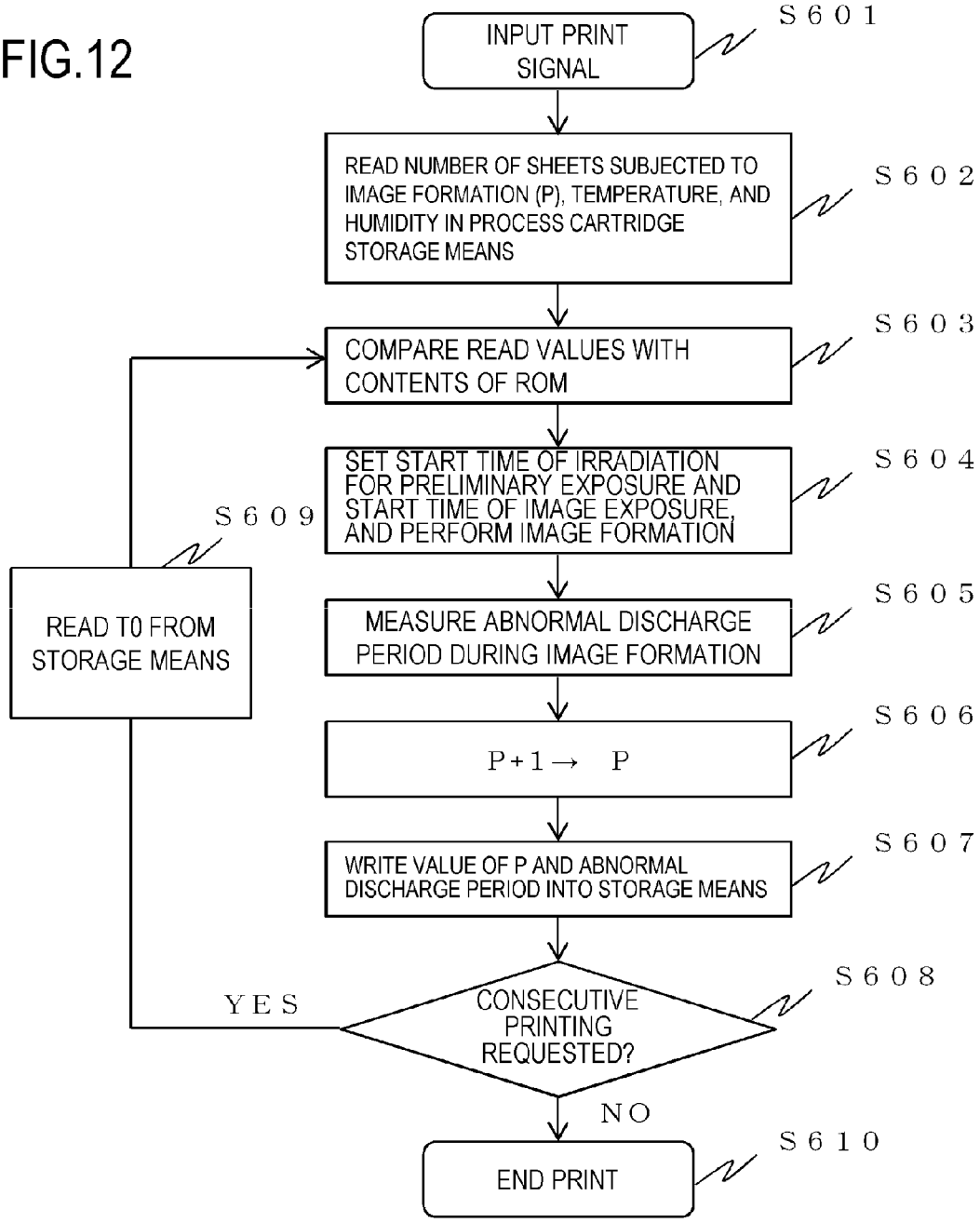
FIG. 12 is a flow chart of control upon start of preliminary exposure according to a fifth practical example of the present invention.

Referring to the flow chart shown in FIG. 12, a method of varying the period between the start of irradiation by the preliminary exposing apparatus 27 and the start of exposure by the scanner 3 according to the fifth practical example will now be described. In the present practical example, an approximation curve is obtained based on a relationship between a charging bias and a charging current, a relationship between a film thickness of the photosensitive drum and a charging current, and a relationship between use environment and a charging current, and data of the approximation curve is stored in the image forming apparatus main body-side ROM 33 in advance. Moreover, while methods of obtaining an approximation curve include statistical methods such as linear approximation, exponential approximation, polynomial approximation, cumulative approximation, and moving average approximation, no particular restrictions apply and an optimal method can be used as appropriate.

The process cartridge Bis equipped with the storage means 26 and the storage means 26 stores the number of sheets subjected to image formation (P) performed using the process cartridge B, temperature and humidity, and the abnormal discharge period T0. When a print signal is input from the host 14 (S601), the CPU 32 communicates with the storage means 26 mounted to the process cartridge B and reads the number of sheets subjected to image formation (P), temperature, and humidity in the process cartridge B (S602). Next, the CPU 32 compares contents of the image forming apparatus main body-side ROM 33 in which abnormal discharge periods in accordance with the number of sheets subjected to image formation, temperature, and humidity have been stored in advance with the values of the number of sheets subjected to image formation (P), the temperature, and the humidity read into the CPU 32 as described above (S603). Furthermore, the CPU 32 calculates an abnormal discharge period when a charging bias is applied during image formation (S603).

Subsequently, the CPU 32 sets a start time of irradiation by the preliminary exposing apparatus 27 and a start time of image exposure by the scanner 3 using the control portion 35 which controls a period from the start of irradiation by the preliminary exposing apparatus 27 to the start of exposure by the scanner 3 and makes a transition to an image formation operation (S604). At this point, in the present practical example, the charging current detecting portion 36 which detects a charging current flowing through the charging roller 2 monitors a charging current from the start of irradiation for preliminary exposure to the end of the image formation operation and measures a period (an abnormal discharge period) until the charging current value returns to a normal value (S605).

When the image formation operation ends, the counted number of sheets subjected to image formation is increased by one (S606) and the counted number of sheets subjected to image formation and the abnormal discharge period T0 in the storage means 26 of the process cartridge B are rewritten (S607). Next, a determination is made on whether consecutive printing has been requested (S608). When such a request has been made, the abnormal discharge period T0 is read from the storage means (S609) and the operations of S603 to S607 are repeated until there are no more requests for consecutive printing. When no such request is made, a transition is made to a print ending operation (S610).

As described above, according to the present practical example, a charging current flowing through the charging roller 2 during consecutive printing is measured and an abnormal discharge period is sequentially calculated based on a period in which the current value exceeds a prescribed range. Accordingly, a period between the start of irradiation by the preliminary exposing apparatus 27 and the start of image exposure by the scanner 3 can be optimized and product life can be increased while avoiding the occurrence of an abnormally discharged image throughout an extended period of use.

SIXTH PRACTICAL EXAMPLE

A sixth practical example of the present invention differs from the respective practical examples described above in that a charging current flowing through the charging roller 2 is measured and when the current value exceeds a prescribed range and an abnormal discharge occurs, a charging bias is optimized so that the current value falls within the prescribed range. Other configurations are similar to those of the respective practical examples described above. Matters not described in the sixth practical example are similar to those of the practical examples described above.

As described in the fourth practical example, when the charging bias increases, the charging current value at point A immediately after the charging bias is applied increases in a manner resembling that of a phase transition due to an abnormal discharge at a specific bias value. In consideration thereof, in the sixth practical example of the present invention, when the current value exceeds a prescribed range, an occurrence of an abnormally discharged image is avoided by lowering the charging bias until the current falls within the prescribed range. Specifically, a magnitude of voltage applied to the charging roller 2 is adjusted based on the current value detected by the charging current detecting portion 36 so that the current value of the current flowing through the charging roller 2 has a magnitude that enables an occurrence of an abnormal discharge state to be avoided. Furthermore, an amount of exposure light of the scanner 3 is adjusted so that a difference in magnitudes of absolute values of a surface potential of the photosensitive drum 1 which is formed by application of voltage with an adjusted magnitude (charged potential) and a surface potential formed by exposing the photosensitive drum.1 after being charged (exposure potential) has an appropriate magnitude. In the configuration of the present practical example, components related to the adjustment of the amount of exposure light of the scanner 3 such as the controller portion 31 and the CPU 32 correspond to an adjusting portion according to the present invention.

<Method of Controlling Interval Between Start of Irradiation by Preliminary Exposing Apparatus and Start of Exposure by Scanner>

Figure 13:
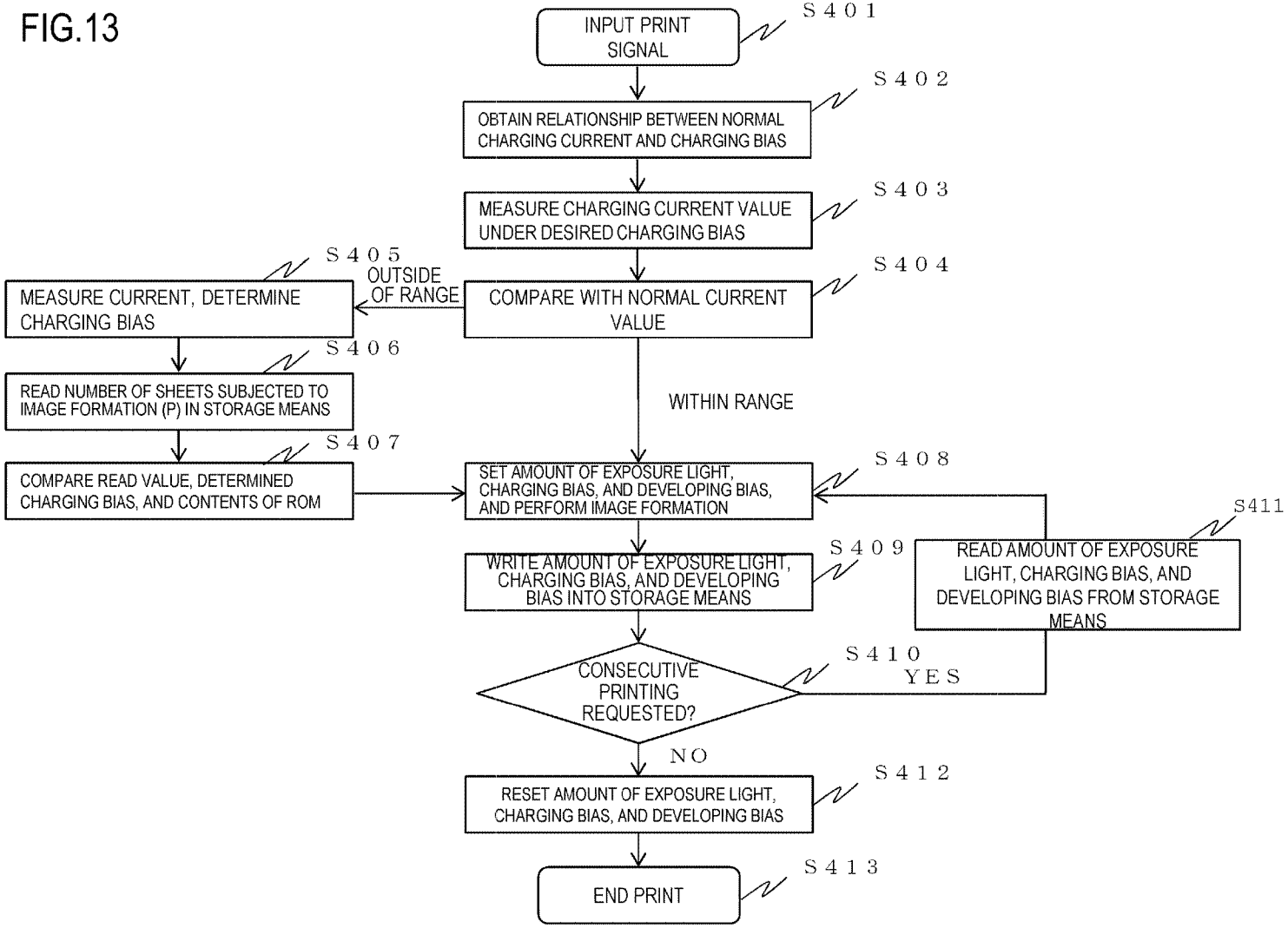
FIG. 13 is a flow chart of control for avoiding an occurrence of an abnormal discharge according to a sixth practical example of the present invention.

Control for avoiding an abnormally discharged image according to the sixth practical example of the present invention will now be described with reference to the flowchart shown in FIG. 13. When a print signal is input from the host 14 (S401), detection of a charging current is performed to obtain a relationship between a normal charging current and a charging bias (S402). Next, a charging current value under a desired charging bias is measured (S403) and a value of a charging current that flows when the desired charging bias is applied and a charging current value during a normal discharge are compared with each other (S404). When the current value is outside a prescribed range, a determination that an abnormal discharge has occurred is made and the charging bias is lowered and changed to a charging bias at which the current value falls within the prescribed range (S405).

A latent image setting will now be described. When an amount of exposure light is the same, lowering a charging bias causes latent image contrast (|Vd−Vl|) to decrease, image density to vary, and the like. In consideration thereof, in the present practical example, the amount of exposure light is varied and control is performed so that latent image contrast and developing contrast (|Vdc−V⊥) become the same.

Specifically, communication is performed with the storage means 26 mounted to the process cartridge B and the number of sheets subjected to image formation (P) is read (S406). Next, the CPU 32 compares contents of the image forming apparatus main body-side ROM 33 in which the number of sheets subjected to image formation and an amount of exposure light in accordance with the charging bias, and developing bias is stored in advance with the values of the number of sheets subjected to image formation (P) read into the CPU 32 as described above and the determined charging bias (S407). Subsequently, the amount of exposure light and the developing bias are set and a transition is made to an image formation operation (S408).

On the other hand, when the current value is within the prescribed number range, a determination is made that an abnormal discharge has not occurred and a transition is made to an image formation operation (S408). When the image formation operation ends, the amount of exposure light, the charging bias, and the developing bias are rewritten to the storage means 26 of the process cartridge B (S409). Next, a determination is made on whether consecutive printing has been requested (S410). When such a request has been made, the amount of exposure light, the charging bias, and the developing bias are read from the storage means (S411) and the operations of S408 to S411 are repeated until there are no more requests for consecutive printing. When no such request is made, the amount of exposure light, the charging bias, and the developing bias are reset to the settings prior to change (S412) and a transition is made to a print ending operation (S413).

As described above, according to the present practical example, since a charging current flowing through the charging roller 2 is measured and when the current value exceeds a prescribed range and an abnormal discharge occurs, a charging bias is optimized so that the current value falls within the prescribed range, an occurrence of an abnormally discharged image can be avoided.

SEVENTH PRACTICAL EXAMPLE

In a seventh practical example of the present invention, a normal charging current value is obtained by measuring a charging current flowing through the charging roller 2 while varying an amount of preliminary exposure light. A difference from the respective practical examples described above is that an amount of preliminary exposure light is optimized so that when a current value exceeds a prescribed range and an abnormal discharge occurs, the current value falls within a prescribed range. Specifically, an amount of exposure light of the preliminary exposing apparatus 27 is adjusted based on the current value detected by the charging current detecting portion 36 so that the current value of the current flowing through the charging roller 2 has a magnitude that enables an occurrence of an abnormal discharge state to be avoided. In the configuration of the present practical example, components related to the adjustment of the amount of exposure light of the preliminary exposing apparatus 27 such as the control portion 35 and the CPU 32 correspond to a second adjusting portion according to the present invention. Other configurations are similar to those of the respective practical examples described above. Matters not described in the seventh practical example are similar to those of the practical examples described above.

<Method of Detecting Abnormal Discharge Period>

A method of detecting an abnormal discharge period will now be described. An abnormal discharge is likely to occur when a potential difference between a pre-charge potential and a charged potential is large. Since the preliminary exposing apparatus 27 exposes an entire surface of the photosensitive drum before the surface of the photosensitive drum is charged by the charging roller 2, a potential difference between a pre-charge potential and a charged potential can be varied with an amount of preliminary exposure light. As described earlier, since the difference in potential between pre-charging potential and charged potential increases as charged potential Vd rises, the greater the charging bias applied to the charging roller 2, the higher the likelihood of an occurrence of an abnormal discharge.

Therefore, even when the charging bias represented by a horizontal axis in FIG. 8 is replaced by the amount of preliminary exposure light, a charging current value exhibits a similar transition. In other words, the charging current value decreases as the amount of preliminary exposure light is reduced and assumes a normal charging current value at or under a certain amount of light. These features reveal a relationship between a normal charging current and an amount of preliminary exposure light from a measurement point at point A with a smaller amount of preliminary exposure light than an amount of preliminary exposure light at which an abnormal discharge occurs. In the present practical example, an approximation line is drawn from the measurement of two points that are equal to or lower than an amount of preliminary exposure light at which an abnormal discharge occurs at point A (immediately after application of charging bias) and a charging current value obtained from the approximation line is adopted as a normal charging current value. In addition, a normal charging current value under a desired amount of preliminary exposure light can be discerned from a relationship between a normal charging current and an amount of preliminary exposure light.

<Method of Controlling Amount of Preliminary Exposure Light>

As described above, the charging current value decreases as the amount of preliminary exposure light is reduced and assumes a normal charging current value at or under a certain amount of light. In consideration thereof, when an abnormal discharge occurs, an occurrence of an abnormally discharged image can be avoided by optimizing the amount of preliminary exposure light until a normal charging current value is assumed.

Figure 14:
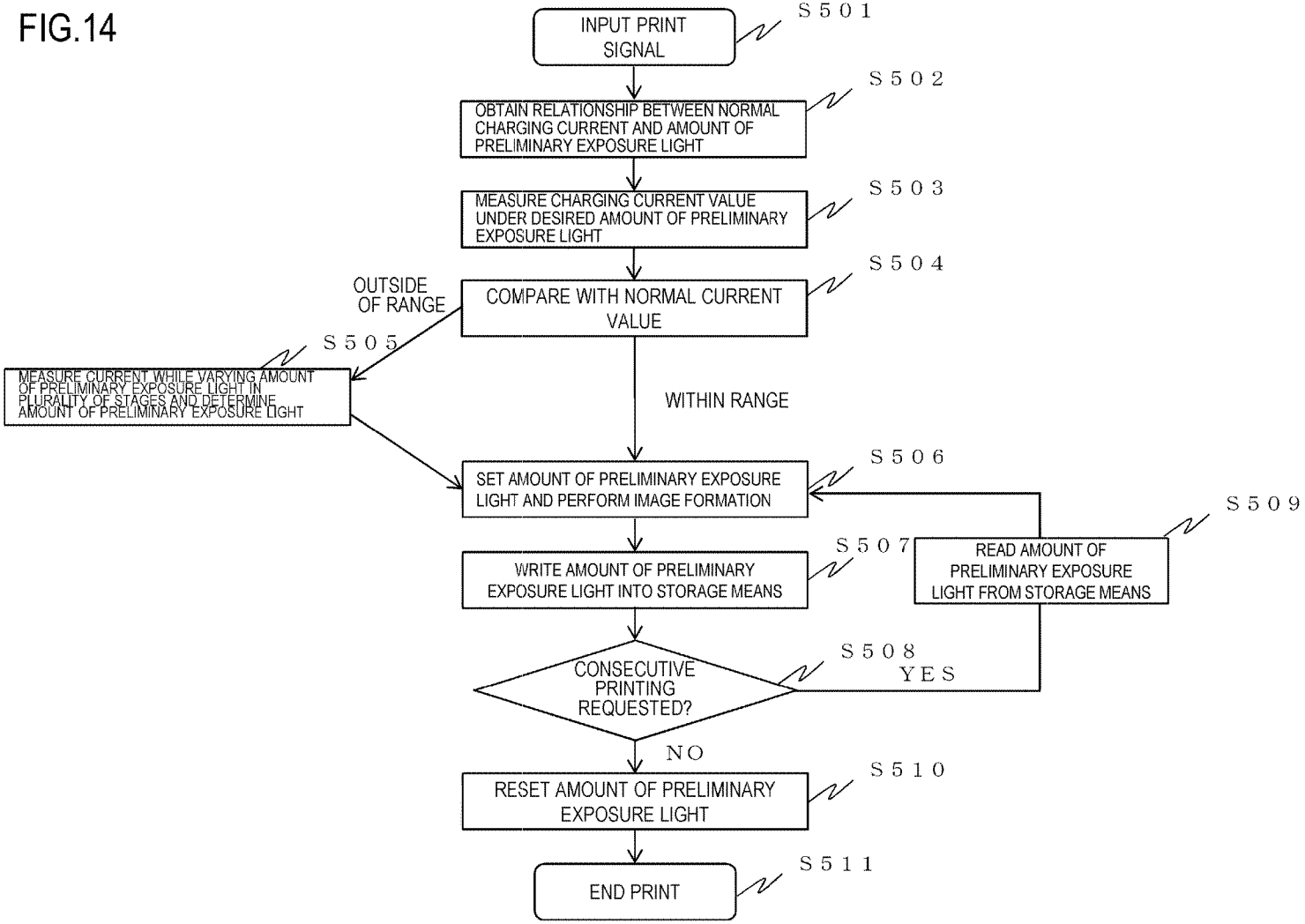
FIG. 14 is a flow chart of control for avoiding an occurrence of an abnormal discharge according to a seventh practical example of the present invention.

Control for avoiding an abnormally discharged image according to the seventh practical example of the present invention will now be described with reference to the flow chart shown in FIG. 14. When a print signal is input from the host 14 (S501), detection of a charging current is performed to obtain a relationship between a normal charging current and an amount of preliminary exposure light (S502). Next, a charging current value under a desired amount of preliminary exposure light is measured (S503) and a value of a charging current that flows under the desired amount of preliminary exposure light and a charging current value during a normal discharge are compared with each other (S504). When the current value is outside of a prescribed range, a determination that an abnormal discharge has occurred is made, the amount of preliminary exposure light is varied by a plurality of stages, and the current value is measured. An amount of preliminary exposure light under which the current value falls within the prescribed range is set (S505) and a transition is made to an image formation operation.

On the other hand, when the current value is within the prescribed number range, a determination is made that an abnormal discharge has not occurred and a transition is made to an image formation operation (S506). When the image formation operation ends, the amount of preliminary exposure light is rewritten to the storage means 26 of the process cartridge B (S507). Next, a determination is made on whether consecutive printing has been requested (S508). When such a request has been made, the amount of preliminary exposure light is read from the storage means (S509) and the operations of S506 to S509 are repeated until there are no more requests for consecutive printing. When no such request is made, the amount of preliminary exposure light is reset to the setting prior to change (S510) and a transition is made to a print ending operation (S511).

As described above, according to the present practical example, since a charging current flowing through the charging roller 2 is measured and when the current value exceeds a prescribed range and an abnormal discharge occurs, an amount of preliminary exposure light is optimized so that the current value falls within the prescribed range, an occurrence of an abnormally discharged image can be avoided. Moreover, while a charging current is measured by varying an amount of preliminary exposure light as a method of detecting an abnormal discharge in the present practical example, a potential difference between a pre-charge potential and a charged potential need only be varied. For example, the pre-charge potential may be varied by varying a transfer bias to measure a charging current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-152508, filed Jul. 31, 2015, which is hereby incorporated by reference herein in its entirety.

What is claimed is:

1. An image forming apparatus performing image formation on recording material based on a print signal, the image forming apparatus comprising:

a photosensitive member;

a charging member which charges the photosensitive member at a charging position;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a control unit which controls a period from a timing at which a portion of the photosensitive member exposed by the second exposing unit is initially charged by the charging member to a timing at which the first exposing unit starts formation of the latent image when performing image formation based on the print signal, wherein the control unit varies a length of the period based on information related to a thickness of a photosensitive layer of the photosensitive member.

2. The image forming apparatus according to claim 1, wherein the control unit performs control so that the smaller the thickness of the photosensitive layer of the photosensitive member, the shorter the period.

3. The image forming apparatus according to claim 1, wherein the information related to the thickness of the photosensitive layer of the photosensitive member is information acquired based on any information related to the number of sheets of recording material on which image formation has been performed, the number of rotations of the photosensitive member as a rotating body, the number of sheets of recording material having passed through the image forming apparatus, and a time during which the photosensitive member is charged by the charging member.

4. The image forming apparatus according to claim 1, wherein the control unit further controls a length of the period based on information related to a charging capability of the charging member.

5. The image forming apparatus according to claim 4, wherein the charging member comes into contact with the photosensitive member at the charging position, and information related to the charging capability is acquired based on at least any of a resistance value of the charging member, a time during which voltage is applied to the charging member, and an integrated value of a current flowing through the charging member.

6. The image forming apparatus according to claim 1, wherein the control unit controls the period so that the first exposing unit performs exposure to form the latent image on a region of the surface of the photosensitive member on a further upstream side in a movement direction of the surface of the photosensitive member than a region of the surface of the photosensitive member charged by the charging member in a state where a charging current equal to or larger than a desired value flows through the charging member.

7. The image forming apparatus according to claim 1, wherein when the image formation is performed based on the print signal, a timing at which the charging member starts charging the photosensitive member arrives earlier than a timing at which the second exposing unit starts exposure.

8. The image forming apparatus according to claim 1, wherein the charging member comes into contact with the photosensitive member at the charging position, and when the charging member charges the photosensitive member, only DC voltage is applied to the charging member.

9. The image forming apparatus according to claim 1, wherein the transferred body is either recording material or an intermediate transfer member to which a toner image is transferred from the photosensitive member and which transfers the transferred toner image to recording material.

10. An image forming apparatus performing image formation on recording material based on a print signal, the image forming apparatus comprising:

a photosensitive member;

a charging member which charges the photosensitive member at a charging position;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a control unit which controls a period from a timing at which a portion of the photosensitive member exposed by the second exposing unit is initially charged by the charging member to a timing at which the first exposing unit starts formation of the latent image when performing image formation based on the print signal, wherein the control unit varies a length of the period based on environmental information.

11. The image forming apparatus according to claim 10, wherein the control unit performs control based on an absolute moisture content.

12. The image forming apparatus according to claim 10, further comprising a temperature and humidity sensor, wherein the environmental information is information acquired based on temperature and humidity detected by the temperature and humidity sensor.

13. The image forming apparatus according to claim 10, wherein the control unit further controls a length of the period based on information related to a charging capability of the charging member.

14. The image forming apparatus according to claim 13, wherein the charging member comes into contact with the photosensitive member at the charging position, and information related to the charging capability is acquired based on at least any of a resistance value of the charging member, a time during which voltage is applied to the charging member, and an integrated value of a current flowing through the charging member.

15. The image forming apparatus according to claim 10, wherein the control unit controls the period so that the first exposing unit performs exposure to form the latent image on a region of the surface of the photosensitive member on a further upstream side in a movement direction of the surface of the photosensitive member than a region of the surface of the photosensitive member charged by the charging member in a state where a charging current equal to or larger than a desired value flows through the charging member.

16. The image forming apparatus according to claim 10, wherein when the image formation is performed based on the print signal, a timing at which the charging member starts charging the photosensitive member arrives earlier than a timing at which the second exposing unit starts exposure.

17. The image forming apparatus according to claim 10, wherein the charging member comes into contact with the photosensitive member at the charging position, and when the charging member charges the photosensitive member, only DC voltage is applied to the charging member.

18. The image forming apparatus according to claim 10, wherein the transferred body is either recording material or an intermediate transfer member to which a toner image is transferred from the photosensitive member and which transfers the transferred toner image to recording material.

19. An image forming apparatus performing image formation on recording material based on a print signal, the image forming apparatus comprising:

a photosensitive member;

a charging member which charges the photosensitive member at a charging position;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a control unit which controls a first period from a timing at which a portion of the photosensitive member exposed by the second exposing unit is initially charged by the charging member to a timing at which the first exposing unit starts formation of the latent image when performing image formation based on a print signal, wherein when a second period during which a charging current flowing through the charging member when the charging member charges the photosensitive member is equal to or larger than a desired value has a length of T1, the control unit sets the first period to Δt1, and when the length of the second period is T2, which is longer than T1, the control unit sets the first period to Δt2, which is longer than Δt1.

20. The image forming apparatus according to claim 19, wherein:

the charging member comes into contact with the photosensitive member at the charging position, the image forming apparatus further comprises: a voltage applying portion which applies voltage to the charging member; a current detecting portion which detects a current flowing through the charging member due to application of voltage by the voltage applying portion; and an acquiring portion which acquires a length of the second period, and the acquiring portion acquires a length of the second period based on a value of a current detected by the current detecting portion.

21. The image forming apparatus according to claim 20, wherein the acquiring portion acquires, as the second period, a period from a timing at which the voltage applying portion starts applying voltage to the charging member based on a value of a current detected by the current detecting portion to a timing at which a value of a current detected by the current detecting portion falls within a prescribed threshold range.

22. The image forming apparatus according to claim 21, wherein the acquiring portion acquires the second period based on a value of a current detected by the current detecting portion during execution of an image formation operation.

23. The image forming apparatus according to claim 19, wherein the control unit controls the first period so that the first exposing unit performs exposure to form the latent image on a region of the surface of the photosensitive member on a further upstream side in a movement direction of the surface of the photosensitive member than a region of the surface of the photosensitive member charged by the charging member in a state where a charging current equal to or larger than a desired value flows through the charging member.

24. The image forming apparatus according to claim 19, wherein when the image formation is performed based on the print signal, a timing at which the charging member starts charging the photosensitive member arrives earlier than a timing at which the second exposing unit starts exposure.

25. The image forming apparatus according to claim 19, wherein the charging member comes into contact with the photosensitive member at the charging position, and when the charging member charges the photosensitive member, only DC voltage is applied to the charging member.

26. The image forming apparatus according to claim 19, wherein the transferred body is either recording material or an intermediate transfer member to which a toner image is transferred from the photosensitive member and which transfers the transferred toner image to recording material.

27. An image forming apparatus comprising:

a photosensitive member which bears a toner image to be transferred to recording material;

a charging member which charges the photosensitive member;

a voltage applying portion which applies voltage to the charging member;

a current detecting portion which detects a current that flows through the charging member;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a first adjusting portion which adjusts an amount of exposure light of the first exposing unit, wherein when an image formation operation is executed after the second exposing unit exposes the photosensitive member, a magnitude of voltage to be applied to the charging member by the voltage applying portion is adjusted based on a value of a current detected by the current detecting portion so that a current value of a current flowing through the charging member has a magnitude that prevents a region of the photosensitive member charged by the charging member after being exposed by the second exposing unit from entering an overcharged state, and wherein the first adjusting portion adjusts an amount of exposure light so that a difference between a magnitude of an absolute value of surface potential of the photosensitive member formed when voltage of a magnitude adjusted by the voltage applying portion is applied to the charging member and a magnitude of an absolute value of surface potential of the photosensitive member formed when the first exposing unit exposes the charged photosensitive member is equal to a prescribed magnitude.

28. The image forming apparatus according to claim 27, wherein the transferred body is either recording material or an intermediate transfer member to which a toner image is transferred from the photosensitive member and which transfers the transferred toner image to recording material.

29. An image forming apparatus comprising:

a photosensitive member which bears a toner image to be transferred to recording material;

a charging member which charges the photosensitive member;

a voltage applying portion which applies voltage to the charging member;

a current detecting portion which detects a current that flows through the charging member;

a first exposing unit which exposes a surface of the charged photosensitive member to form a latent image;

a second exposing unit which exposes the surface of the photosensitive member after the surface of the photosensitive member passes a transfer position at which a toner image obtained by causing toner to adhere to the latent image is transferred to a transferred body and before the surface of the photosensitive member reaches the charging position; and a second adjusting portion which adjusts an amount of exposure light of the second exposing unit, wherein when an image formation operation is executed after the second exposing unit exposes the photosensitive member, the second adjusting portion adjusts an amount of exposure light based on a value of a current detected by the current detecting portion so that a current value of a current flowing through the charging member has a magnitude that prevents a region of the photosensitive member charged by the charging member after being exposed by the second exposing unit from entering an overcharged state.

30. The image forming apparatus according to claim 29, wherein the transferred body is either recording material or an intermediate transfer member to which a toner image is transferred from the photosensitive member and which transfers the transferred toner image to recording material.

* * * * *